US012782030B2

(12) United States Patent
Vijayan et al.

(10) Patent No.: US 12,782,030 B2
(45) Date of Patent: Nov. 3, 2026

(54) ICE MAKER APPLIANCE WITH ADDITIVE CONCENTRATION CONTROL

(71) Applicant: Haier US Appliance Solutions, Inc., Wilmington, DE (US)

(72) Inventors: Vineeth Vijayan, Louisville, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 128 days.

(21) Appl. No.: 18/668,955

(22) Filed: May 20, 2024

(65) Prior Publication Data

US 2025/0354741 A1 Nov. 20, 2025

(51) Int. Cl.
*F25C 1/25* (2018.01)

(52) U.S. Cl.
CPC ..... *F25C 1/25* (2018.01); *F25C 2400/00* (2013.01)

(58) Field of Classification Search
CPC ..... F25C 1/25; F25C 1/104; F25C 2400/14; F25C 2400/10; F25C 1/18
See application file for complete search history.

(56) References Cited

U.S. PATENT DOCUMENTS

| | | | |
|---|---|---|---|
| 2,237,525 A | 4/1941 | Nolan | |
| 2,918,803 A | 12/1959 | Bauerlein et al. | |
| 4,174,742 A | 11/1979 | Murphey | |
| 6,513,337 B1 | 2/2003 | Astvatsatrian et al. | |
| 6,513,578 B2 | 2/2003 | Frank | |
| 6,672,097 B1 * | 1/2004 | Ashley | A23G 9/163 62/340 |
| 7,472,643 B2 | 1/2009 | Mitchell et al. | |
| 8,794,025 B2 | 8/2014 | Rugeris | |
| 8,794,126 B2 | 8/2014 | Skalski et al. | |
| 9,038,410 B2 | 5/2015 | Erbs et al. | |
| 9,066,529 B2 | 6/2015 | Fassberg et al. | |
| 9,169,112 B2 | 10/2015 | Chase et al. | |
| 9,198,534 B2 | 12/2015 | Skalski et al. | |
| 9,664,437 B2 | 5/2017 | Anselmino et al. | |
| 9,693,650 B2 | 7/2017 | Skalski et al. | |
| 9,759,470 B2 | 9/2017 | Zisholtz et al. | |

(Continued)

FOREIGN PATENT DOCUMENTS

| | | |
|---|---|---|
| CN | 101871711 B | 8/2012 |
| CN | 102297551 B | 4/2013 |

(Continued)

OTHER PUBLICATIONS

JP-H11211296-A translation.*
EP-4275509-A1.*
JPH11211296 translation.*

*Primary Examiner* — Elizabeth J Martin
(74) *Attorney, Agent, or Firm* — Dority & Manning, P.A.

(57) ABSTRACT

An ice maker appliance includes a mold body comprising a mold cavity, a fill tube, and a dosing pump. Methods of operating the ice maker appliance may include receiving a user input. A volume of liquid water and/or a volume of additive may be determined based on the user input. Methods may further include flowing the liquid water and the additive to the mold cavity. The liquid water and the additive form a mixture, and the mixture is retained in the mold cavity to form at least a portion of an ice piece.

19 Claims, 16 Drawing Sheets

(56) References Cited

U.S. PATENT DOCUMENTS

| | | | | |
|---|---|---|---|---|
| 9,783,405 | B2 | 10/2017 | Olson et al. | |
| 10,378,806 | B2 | 8/2019 | Boarman et al. | |
| 2006/0254300 | A1 | 11/2006 | Rugeris | |
| 2009/0120306 | A1 | 5/2009 | DeCarlo et al. | |
| 2016/0205988 | A1 | 7/2016 | Bird et al. | |
| 2016/0216020 | A1 | 7/2016 | Safrin | |
| 2017/0042181 | A1 | 2/2017 | Fiaschi | |
| 2021/0356190 | A1* | 11/2021 | Bae | F25C 1/25 |

FOREIGN PATENT DOCUMENTS

| | | | | | |
|---|---|---|---|---|---|
| CN | 110906645 | A | | 3/2020 | |
| CN | 215898788 | U | | 2/2022 | |
| CN | 111854248 | B | | 3/2022 | |
| CN | 113028694 | B | | 8/2023 | |
| DE | 20218085 | U1 | | 2/2003 | |
| EP | 4275509 | A1 | * | 11/2023 | A23G 9/08 |
| JP | H11211296 | A | * | 8/1999 | |
| WO | WO1991000238 | A1 | | 1/1991 | |

* cited by examiner

ICE MAKER APPLIANCE WITH ADDITIVE CONCENTRATION CONTROL

FIELD OF THE INVENTION

The present subject matter relates generally to ice maker appliances, and in particular to ice maker appliances configured to produce infused ice from water and an additive such as a flavorant, e.g., ice that is infused with one or more additives.

BACKGROUND OF THE INVENTION

Certain refrigerator appliances include an ice maker. An ice maker appliance may also be a stand-alone appliance designed for use in commercial and/or residential settings. To produce ice, liquid water is directed to the ice maker and frozen. For example, certain ice makers include a mold body for receiving liquid water. In some systems, a working fluid is used to directly cool the mold body, e.g., by conductive heat transfer. In other systems, the air around the mold body may be cooled such that the mold body is indirectly cooled via the air. When the mold body is cooled, directly and/or indirectly, ice may be formed from the liquid water therein. After ice is formed in the mold body, it may be harvested from the mold body and stored within an ice bin or bucket within the refrigerator appliance.

Conventional ice maker appliances are configured for producing monolithic, homogenous ice pieces solely from water, e.g., tap water or water from other similar sources. Thus, the resulting ice from such ice maker appliances may be perceived as bland and lacking in visual aesthetic appeal. Thus, there is a desire for ice maker appliances which can produce enhanced ice.

The perception of, and desire for, an intensity of additive, e.g., color, flavor, etc., in the ice piece may vary from one user to another and/or may vary based on the nature of the water which is supplied to the ice maker appliance for mixing with the additive and forming the ice piece, such as a higher concentration of flavorant additive may be desired when the water has a distinctive taste, such as beach water.

Accordingly, an ice maker with features for producing infused ice from water and an additive, such as a flavorant, electrolytes, vitamins, and/or other similar additives, would be desirable. In particular, an ice maker appliance which provides features for customizing the concentration of the additive are desired in the art.

BRIEF DESCRIPTION OF THE INVENTION

Aspects and advantages of the invention will be set forth in part in the following description, or may be apparent from the description, or may be learned through practice of the invention.

According to an exemplary embodiment, a method of operating an ice maker appliance is provided. The ice maker appliance includes a mold body comprising a mold cavity, a fill tube operable to provide a flow of liquid water to the mold cavity, and a dosing pump operable to motivate a flow of additive to the mold cavity. The method includes receiving a user input and flowing a volume of liquid water from the fill tube to the mold cavity. The method also includes operating the dosing pump according to an operating parameter to motivate a flow of additive to the mold cavity. The operating parameter is based on the user input. As a result, a volume of additive proportional to the operating parameter of the dosing pump is provided to the mold cavity. The method further includes retaining a mixture comprising the volume of liquid water and the volume of additive proportional to the operating parameter of the dosing pump in the mold cavity to form at least a portion of an ice piece. Thus, the formed ice piece comprises the water and the additive.

According to another exemplary embodiment, a method of operating an ice maker appliance is provided. The ice maker appliance includes a mold body comprising a mold cavity, a fill tube operable to provide a flow of liquid water to the mold cavity, and a dosing pump operable to motivate a flow of additive to the mold cavity. The method includes receiving a user input and determining a volume of liquid water based on the user input. The method further includes flowing the determined volume of liquid water from the fill tube to the mold cavity. The method also includes operating the dosing pump to motivate a flow of additive to the mold cavity. As a result, a volume of additive is provided to the mold cavity. The method further includes retaining a mixture comprising the determined volume of liquid water and the volume of additive in the mold cavity to form at least a portion of an ice piece. Thus, the formed ice piece comprises the water and the additive.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
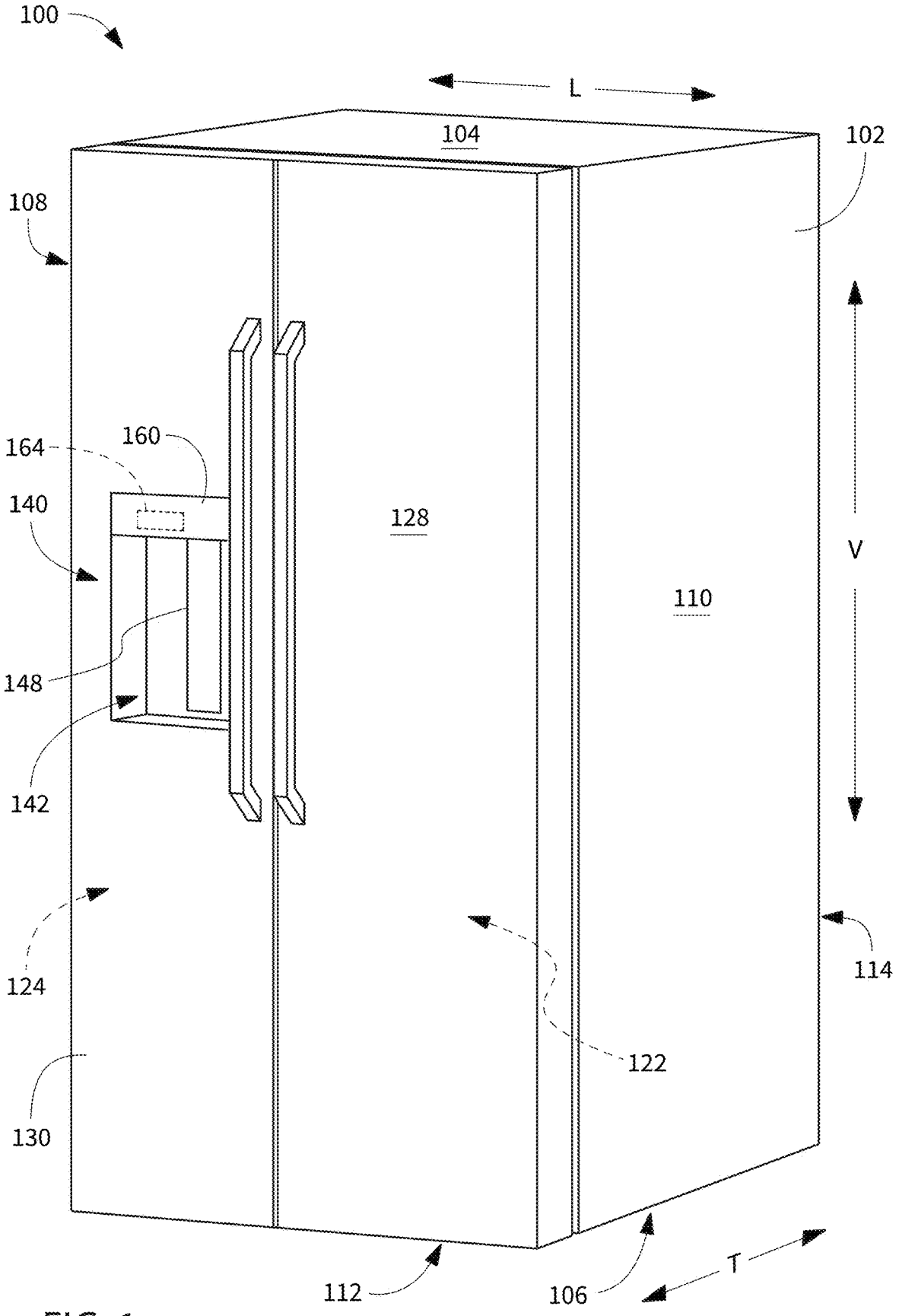
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise. As used herein, the terms "first," "second," and "third" may be used interchangeably to distinguish one component from another and are not intended to signify location or importance of the individual components.

Furthermore, the skilled artisan will recognize the interchangeability of various features from different embodiments. Similarly, the various method steps and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent a right side (e.g., second side 110) of housing 102 and a freezer chamber 124 arranged at or adjacent a left side (e.g., first side 108) of housing 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance, a bottom mount refrigerator appliance, or a single door refrigerator appliance (such as a refrigerator appliance with a single chilled chamber therein, e.g., a standalone freezer or standalone refrigerator appliance, such as a columns unit). Consequently, the description set forth herein is for illustrative purposes only and is not intended to be limiting in any aspect to any particular refrigerator chamber configuration.

Refrigerator door 128 is rotatably hinged to an edge of housing 102 for selectively accessing fresh food chamber 122. In addition, a freezer door 130 is arranged opposite refrigerator door 128 for selectively accessing freezer chamber 124. Refrigerator door 128 and freezer door 130 are shown in the closed configuration in FIG. 1. One skilled in the art will appreciate that other chamber and door configurations are possible and within the scope of the present invention.

Referring still to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of the doors, e.g., freezer door 130. In this regard, dispenser recess 142 is defined on front side 112 of refrigerator appliance 100 such that a user may operate dispensing assembly 140 without opening freezer door 130. In addition, dispenser recess 142 is positioned at a predetermined elevation convenient for a user to access ice and enabling the user to access ice without the need to bend over. In the exemplary embodiment, dispenser recess 142 is positioned at a level that approximates the chest level of a user.

Dispensing assembly 140 includes an ice dispenser including a discharging outlet for discharging ice from dispensing assembly 140. An actuating mechanism 148, shown as a paddle, is mounted below discharging outlet for operating an ice or water dispenser. In alternative exemplary embodiments, any suitable actuating mechanism may be used to operate the dispenser. For example, the dispenser may include a sensor (such as an ultrasonic sensor) or a button rather than the paddle. The discharging outlet and the actuating mechanism 148 are an external part of the ice and/or water dispenser and are mounted in dispenser recess 142.

Returning again to FIG. 1, a control panel 160 is provided for controlling the mode of operation. For example, control panel 160 may include one or more selector inputs (not shown), such as knobs, buttons, touchscreen interfaces, etc., such as a water dispensing button and an ice-dispensing button, for selecting a desired mode of operation such as crushed or non-crushed ice. In addition, the selector inputs may be used to specify a fill volume or method of operating dispensing assembly 140. In this regard, the selector inputs may be in communication with a processing device or controller 164. Signals generated in controller 164 operate refrigerator appliance 100 and dispensing assembly 140 in response to selector inputs. Additionally, a display, such as an indicator light or a screen, may be provided on control panel 160. The display may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions and/or data that when executed by the processing device, cause the processing device to perform operations. For example, the instructions may include a software package configured to operate the system to, e.g., execute the exemplary methods described below. In exemplary embodiments, the various method steps as disclosed herein may be performed, e.g., in whole or part, by controller 164 and/or another, separate, dedicated controller.

Figure 2:
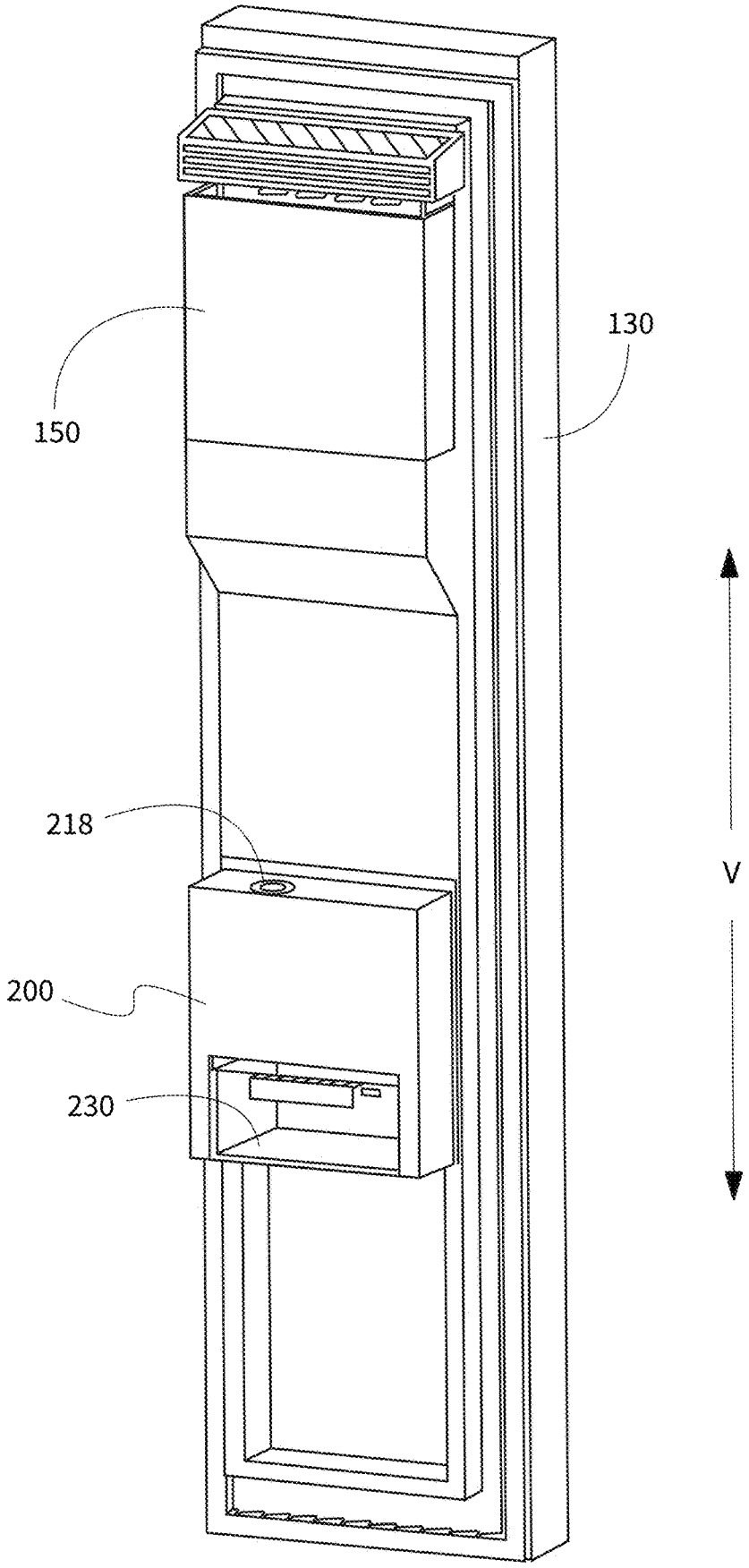
FIG. 2 provides a perspective view of an internal side of an exemplary door for a refrigerator appliance such as the exemplary refrigerator appliance of FIG. 1.
Figure 3:
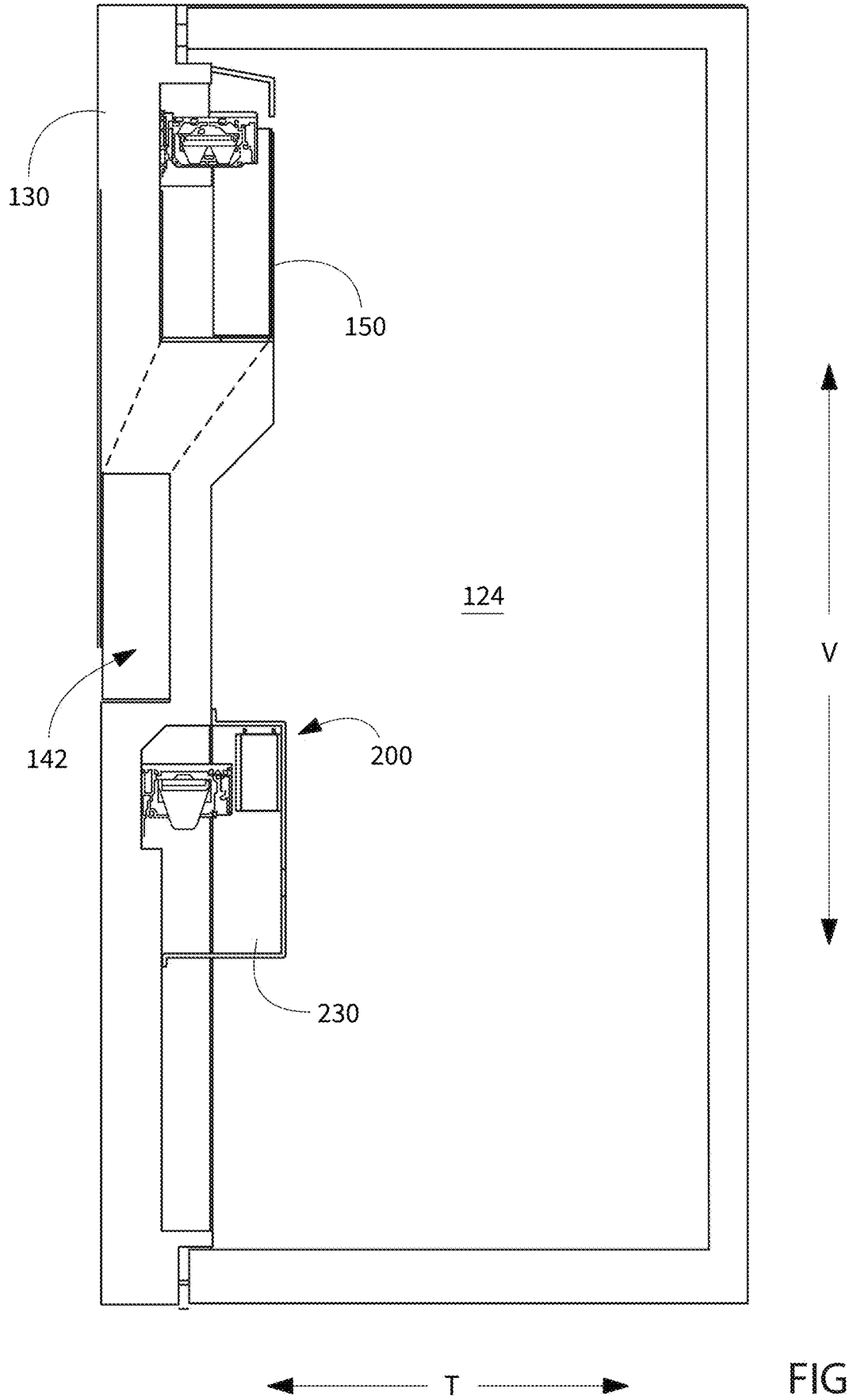
FIG. 3 provides a section view of the exemplary refrigerator appliance of FIG. 1.

Turning now to FIG. 2, an inner side of freezer door 130 is illustrated. FIG. 3 illustrates a section through the exemplary refrigerator appliance 100 at the freezer chamber 124. As may be seen in FIGS. 2 and 3, an icebox 150 may be defined on the inner side of the freezer door 130. Thus, as shown, e.g., in FIG. 3, the icebox 150 may be disposed within the freezer chamber 124 when the freezer door 130 is in the closed position. The icebox 150 may house an ice maker, which may be a primary ice maker of the refrigerator appliance and which may be configured to supply ice to dispenser recess 142. In this regard, for example, icebox 150 may define an ice making chamber for housing ice maker (e.g., a first or primary ice maker configured for making water ice or plain ice), a storage mechanism, and a dispensing mechanism.

Refrigerator appliance 100 may further include a second ice maker 200 (sometimes also referred to as an ice making assembly 200), such as may be configured for making infused ice, e.g., flavored ice. For example, when the first or primary ice maker configured for making water ice or plain ice is provided, the second ice maker 200 which makes infused ice may be a specialty or auxiliary ice maker. As may be seen in FIGS. 2 and 3, ice making assembly 200 may be defined on the inner side of the freezer door 130, such that the ice making assembly 200 may be disposed within the freezer chamber 124 when the freezer door 130 is in the closed position. The ice maker 200 is generally configured for freezing liquid water mixed with an additive to form the infused ice, e.g., infused ice pieces such as ice cubes. For example, the ice maker 200 may include one or more mold cavities 226 (see, e.g., FIGS. 4 through 10) defined therein, such as in a mold body 220 thereof, and the liquid water and additive may be directed into the mold cavity (or cavities) 226 of the ice maker 200. The liquid water and additive may be mixed together while flowing to the mold body 220 and/or may mix in the mold body 220, and the mixed liquid may then be retained in the mold body at a temperature at or below the freezing point of water to form an ice piece or ice pieces. Such ice pieces may be harvested from the mold body 220 and stored in an ice bin 230, e.g., below the mold body 220 such that the ice bin 230 may receive the infused ice pieces from the mold body 220 by gravity.

As mentioned above, the present disclosure may also be applied to other types and styles of refrigerator appliances such as, e.g., a top mount refrigerator appliance, a bottom mount refrigerator appliance, or may be applied to a standalone ice maker appliance. Variations and modifications may be made to ice making assembly while remaining within the scope of the present subject matter. Accordingly, the description herein of the icebox 150 and ice maker 200 on the door 130 of the freezer chamber 124 is by way of example only. In other example embodiments, the ice making assembly or ice maker 200 may be positioned in the fresh food chamber 122, e.g., of the illustrated side by side refrigerator, of a bottom-mount refrigerator, of a top-mount refrigerator, or any other suitable refrigerator appliance. As another example, the ice making assembly 200 may also be provided in a standalone ice maker appliance and/or may be the only ice making assembly in the ice maker appliance. As used herein, the term "standalone ice maker appliance" refers to an appliance of which the sole or primary operation is generating or producing ice, e.g., without any additional or other chilled chambers, whereas the more general term "ice maker appliance" includes such appliances as well as appliances with diverse capabilities in addition to making ice, such as a refrigerator appliance equipped with an ice maker, among other possible examples.

In some embodiments, the ice maker 200 may include a dedicated controller, e.g., similar to the controller 164 of the refrigerator appliance 100 which is described above. In embodiments where the ice maker 200 is incorporated into a refrigerator appliance such as the exemplary refrigerator appliance 100 described hereinabove, the dedicated controller may be in addition to the controller 164 of the refrigerator appliance and may be in communication with the controller 164 of the refrigerator appliance 100, and the controller of the ice maker 200 may be in operative communication with other components of the ice maker 200 and may be configured specifically for controlling or directing operation of such components.

Figure 4:
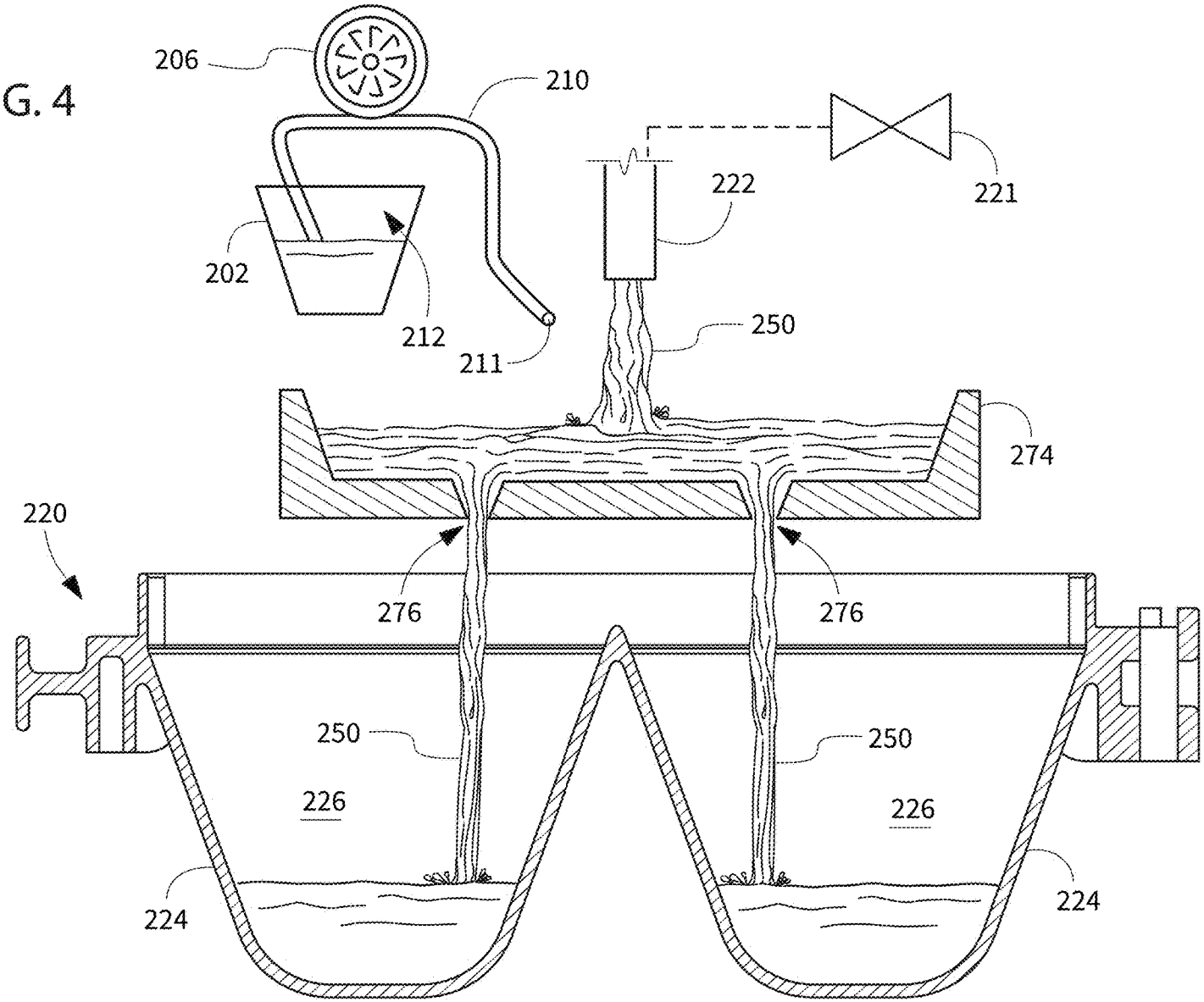
FIG. 4 provides a schematic view of an ice making assembly for an ice maker appliance, such as the exemplary refrigerator appliance of FIG. 1, in accordance with one or more exemplary embodiments of the present disclosure.
Figure 5:
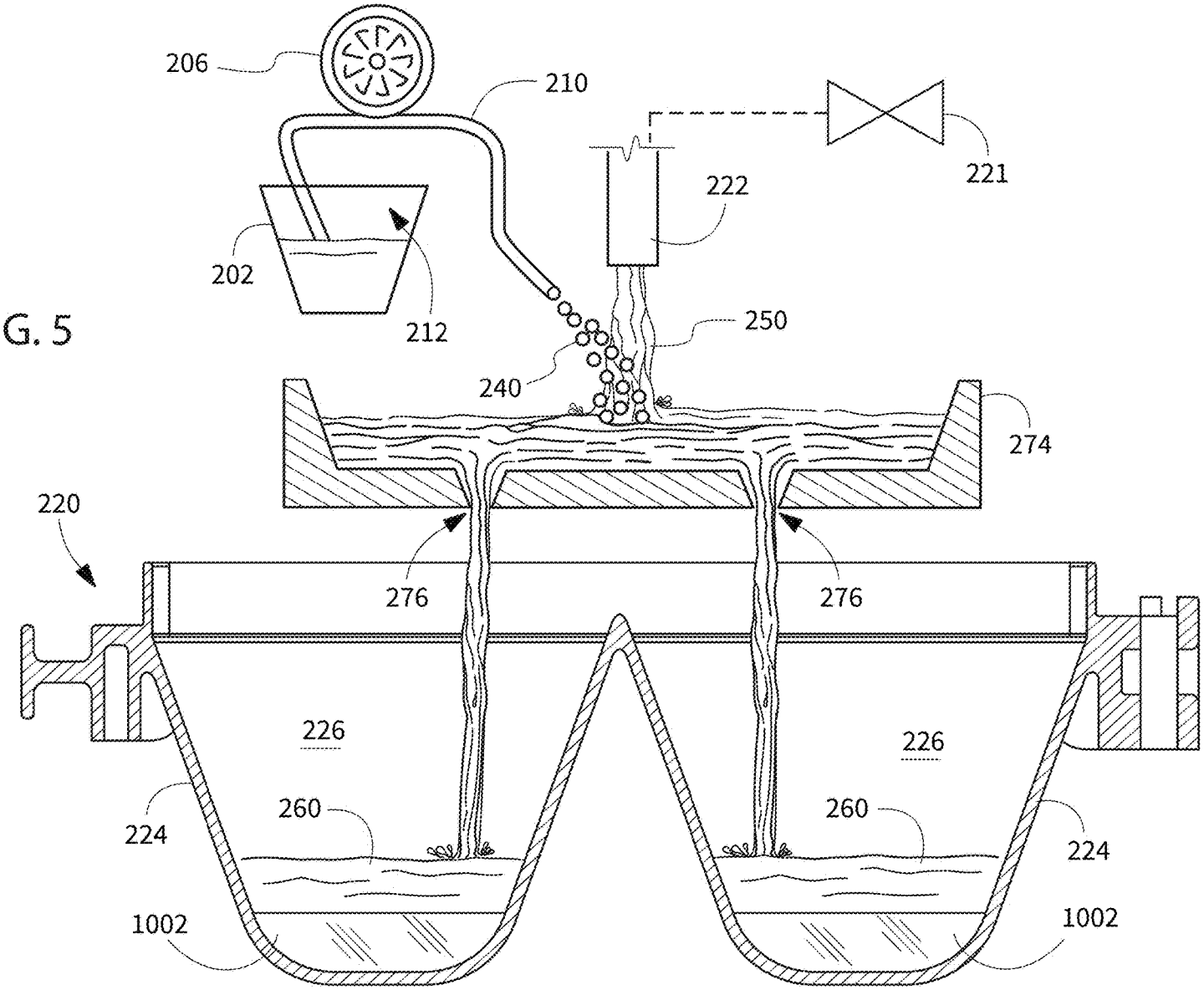
FIG. 5 provides another schematic view of the ice making assembly of FIG. 4.

Referring now to FIGS. 4 and 5, an exemplary embodiment of the ice maker 200 is illustrated. In some embodiments, the ice maker 200 may include an additive receiver 202, which may be a cup, reservoir, or chamber in which an additive may be received, such as directly received, or a pod or other container holding the additive may be received in the additive receiver 202. A lid or door 218 (FIG. 2) may be provided in order to permit access to the additive receiver 202, e.g., for adding, replacing, or removing additive from the additive receiver 202. As may be seen in FIGS. 4 and 5, a dispensing tube 210 may extend from the additive receiver 202 to provide a flow of additive 240 (FIG. 5) from the additive receiver 202 to the mold body 220, as will be discussed further below. The ice maker 200 may further include a water fill tube 222, e.g., which is coupled to a water supply to provide plain water 250 (e.g., tap water such as from a municipal water system, well, or other similar source of potable water, such that "plain water" is intended to refer to typical drinking water as is understood by those of ordinary skill in the art). A fill valve 221 may be coupled in line with the water fill tube 222, such that the liquid water from the water supply may flow through the water fill tube 222 and from the water fill tube 222 to the mold body 220 when the valve 221 is in an open position, whereas such flow may be limited or obstructed when the valve 221 is in a closed position. Accordingly, the valve 221 may be operatively coupled to a controller of the ice maker appliance whereby the valve 221 may be opened for an amount of time to provide a volume of liquid water to the mold body 220. The mold body 220 may be downstream of, e.g., below, the additive dispensing tube 210 and the water fill tube 222, such that the mold body 220 receives both water and additive in order to form infused ice from both the liquid water and the additive in the mold body 220.

As may be seen, e.g., in FIGS. 4 and 5, the mold body 220 of the ice maker 200 may include one or more compartments 224 which define mold cavities 226 for receiving liquid therein, such as alternating volumes of distinct liquids to form distinct layers in the resultant ice piece, or a single volume of liquid (e.g., a mixture of liquid water and liquid additive) to form a single layer ice piece. In embodiments where more than one volume of liquid is provided, each successive volume of liquid, e.g., liquid water alone or liquid water mixed with additive, may be retained within the compartment(s) 224 until ice is formed, e.g., the liquid may be held in the mold cavity 226 and cooled until the liquid freezes before flowing a subsequent volume of liquid into the mold body 220, thereby forming one or more layered ice pieces, e.g., comprising at least one enhanced or infused layer from water and additive (or the enhanced layer may include only additive) and at least one layer comprising water only. In embodiments where a single volume of liquid is provided, the single volume, e.g., mixture of water and additive as mentioned, may be retained within the compartment(s) 224 until ice is formed, e.g., the liquid may be held in the mold cavity 226 and cooled until the liquid freezes, thereby forming one or more enhanced or infused ice pieces, e.g., an ice piece or pieces comprising water and the additive.

A dosing pump 206 may be connected to the additive receiver 202, such as the dosing pump 206 may be connected to the additive receiver 202 via the dispensing tube 210, such as the dosing pump 206 may be coupled in line with the dispensing tube 210 or the dosing pump 206 may be a peristaltic pump engaged with an outer surface of the dispensing tube 210 (as will be described further below with reference to FIGS. 12 and 13). In additional embodiments, the dosing pump 206 may be, e.g., a bellows pump, a gear pump, a piston or plunger pump, a diaphragm pump, a magnetic pump, or other suitable pump for metering or dosing an amount of additive to the mold body 220.

The dispensing tube 210 may be downstream of the additive receiver 202, such that a flow of additive from the additive receiver 202 may be urged by the dosing pump 206 to the mold body 220 via the dispensing tube 210. For example, the dispensing tube 210 may extend from an inlet of the dispensing tube 210 coupled to the additive receiver 202 to an outlet 211 of the dispensing tube 210.

The additive receiver 202 may define an internal volume 212 which is sized and configured to hold a volume of liquid additive, such as a volume that is, in proportion to the total volume of the mold cavity (or cavities) 226, sufficient for mixing with a volume of water to form infused ice pieces in the mold cavity 226. In some embodiments, the liquid additive may be poured directly into the additive receiver 202. In additional embodiments, the additive receiver 202 may also be sized and configured to hold a vessel, e.g., pod, containing the volume of liquid additive therein as well as or instead of liquid added directly into the additive receiver 202 (e.g., the internal volume 212 may be sized and configured to alternately receive liquid directly therein for one batch of enhanced ice and to receive a vessel therein for another batch of enhanced ice). Thus, the additive receiver 202 may be configured to hold an additive, such as a liquid additive, for mixing with liquid water as the liquid water flows from a fill tube 222 of the ice maker 200. The additive may be provided to and stored in the additive receiver 202 in a liquid state, and may remain in the liquid state at least until the additive mixes with liquid water.

Also illustrated in FIGS. 4 and 5 is a stream of water 250 emanating from the water fill tube 222, and, in FIG. 5 a stream of additive 240 emanating from an outlet 211 of the dispensing tube 210 is also illustrated. In some embodiments, a trough or cup, e.g., a fill cup 274, may be positioned between the fill tube 222 and the mold body 220. In such embodiments, the fill cup 274 may include two or more outlets 276, and each outlet 276 of the two or more outlets 276 may be positioned and configured to direct a flow of liquid to only one of the two or more mold cavities 226, and each mold cavity 226 of the two or more mold cavities 226 may be positioned and configured to receive the flow of liquid from only one of the two or more outlets 276. Thus, the outlets 276 and the mold cavities 226 may be paired in a one-to-one correspondence, e.g., one outlet 276 for each mold cavity 226, and one mold cavity 226 for each outlet 276. For example, in the illustrated embodiments, two mold cavities 226 are provided and the fill cup 274 includes two outlets 276. Also as may be seen in FIGS. 4 and 5, each outlet 276 may be in direct fluid communication with the respective mold cavity 226, such that the liquid (e.g., water and/or additive) flows to each mold cavity 226 from each outlet 276 without flowing through any intervening structures.

Accordingly, the mold body 220, e.g., the one or more mold cavities 226 therein, may be positioned downstream of the dispensing tube 210 and downstream of the fill tube 222, such as downstream of the fill cup 274 which receives the flow of additive 240 from the dispensing tube 210 and the flow of liquid water 250 from the fill tube 222.

Referring now to FIG. 4 in particular, in some embodiments, the ice maker 200 may be operable for flowing a first volume of liquid into at least one of the mold cavities, e.g., into both of the two mold cavities 226 illustrated in FIG. 4 at the same time. In such embodiments, the ice maker 200 may be further configured for retaining the first volume of liquid in the at least one of the mold cavities (e.g., both or all of the mold cavities in embodiments which include the fill cup 274 as illustrated in FIG. 4 and described above) for a first predetermined time after flowing the first volume of liquid into the at least one of the mold cavities. As a result of retaining the first volume of liquid in the mold cavity or cavities for the first predetermined time, a first layer of an ice piece 1000 (see, e.g., FIGS. 11A-11D) forms from the first volume of liquid in the mold cavity or cavities. As illustrated in FIG. 4, the first volume of liquid may be water only, such that the first layer of the ice piece 1000 is a water layer 1002 (see, e.g., FIG. 5).

Referring now to FIG. 5 in particular, in such embodiments the ice maker 200 may also be configured for flowing a second volume of liquid into the at least one of the mold cavities after the first layer of the ice piece forms, and retaining the second volume of liquid in the at least one of the mold cavities for a second predetermined time to form a second layer of the ice piece. In some embodiments, the second volume of liquid may be a different liquid than the first volume of liquid, e.g., as illustrated in FIGS. 4 and 5, one of the first volume and the second volume may be water only and the other of the first volume and the second volume may be a mixture of additive and water.

In exemplary embodiments where the first volume and/or second volume of liquid (or the single volume of liquid in additional embodiments) is or includes the mixture of additive and water, e.g., as illustrated in FIG. 5, the stream of additive 240 and the stream of water 250 may mix at least partially in the fill cup 274, forming a mixture 260 of water and additive. The mixing may be complete in the fill cup 274 alone, or the additive and the water may be only partially mixed in the fill cup 274, e.g., the mixing of the water 250 and additive 240 may continue as the liquid flows into the mold cavity 226, and the mixture 260 may only completely form (e.g., mixing of the water 250 and additive 240 may be completed) in the mold cavity 226.

Thus, in such embodiments, the mold cavity 226 may be configured for receiving the mixture 260 of liquid water and liquid additive, e.g., from the fill cup 274. The mold cavity 226 may be further configured for retaining the mixture 260 of liquid water and liquid additive to form a second layer of the ice piece from the mixture 260 in the mold cavity. For example, in embodiments such as the exemplary embodiment illustrated in FIG. 5, the second layer may be a mixed layer 1004 (see, e.g., FIGS. 11A-11D) which is formed from the mixture 260 of additive 240 and water 250. In additional embodiments, the mixed layer may be the only layer in a single layer ice piece according to the present disclosure, or multiple mixed layers having different concentrations may be formed in an ice piece.

In some embodiments, the first volume may be the same volume as the second volume, or the second volume and the first volume may differ. In embodiments where the first volume is a different volume than the second volume, the resultant first and second layers of the ice piece 1000 will have different thicknesses or heights. In some embodiments, the first predetermined time may be the same amount of time as the second predetermined time, or the first predetermined time and the second predetermined time may be different lengths of time. For example, varying the length of time for each volume of liquid may also create distinct layers, such as one layer may be clear while another layer may be cloudy. In various embodiments of the present disclosure, the first and second volumes may be different liquids, different volumes, or both. Moreover, any of the foregoing variations may be combined with the first predetermined time and the second predetermined time being approximately the same or being different amounts of time.

Figure 6:
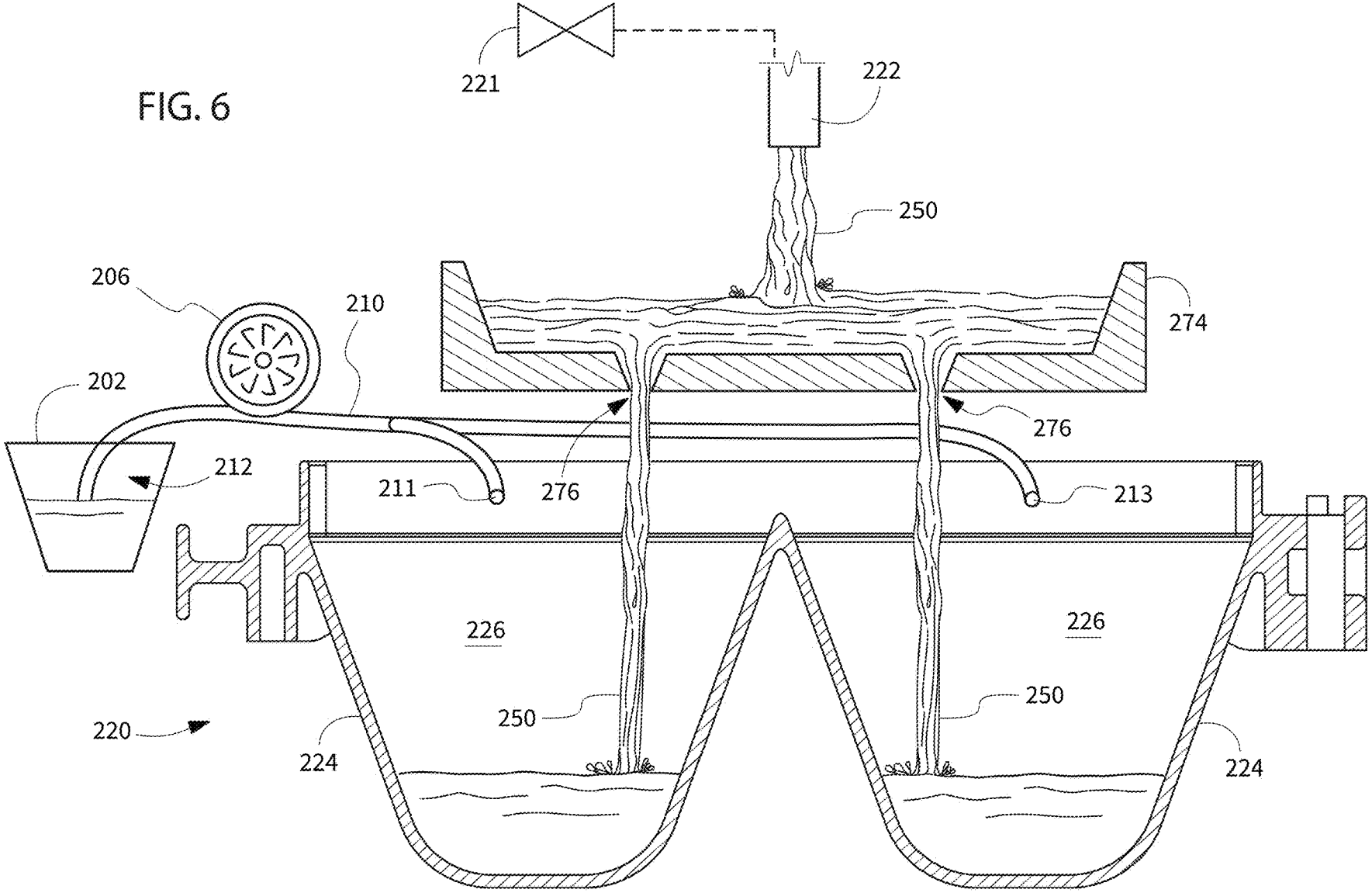
FIG. 6 provides a schematic illustration of an ice making assembly for an ice maker appliance, such as the exemplary refrigerator appliance of FIG. 1, in accordance with one or more additional exemplary embodiments of the present disclosure.
Figure 7:
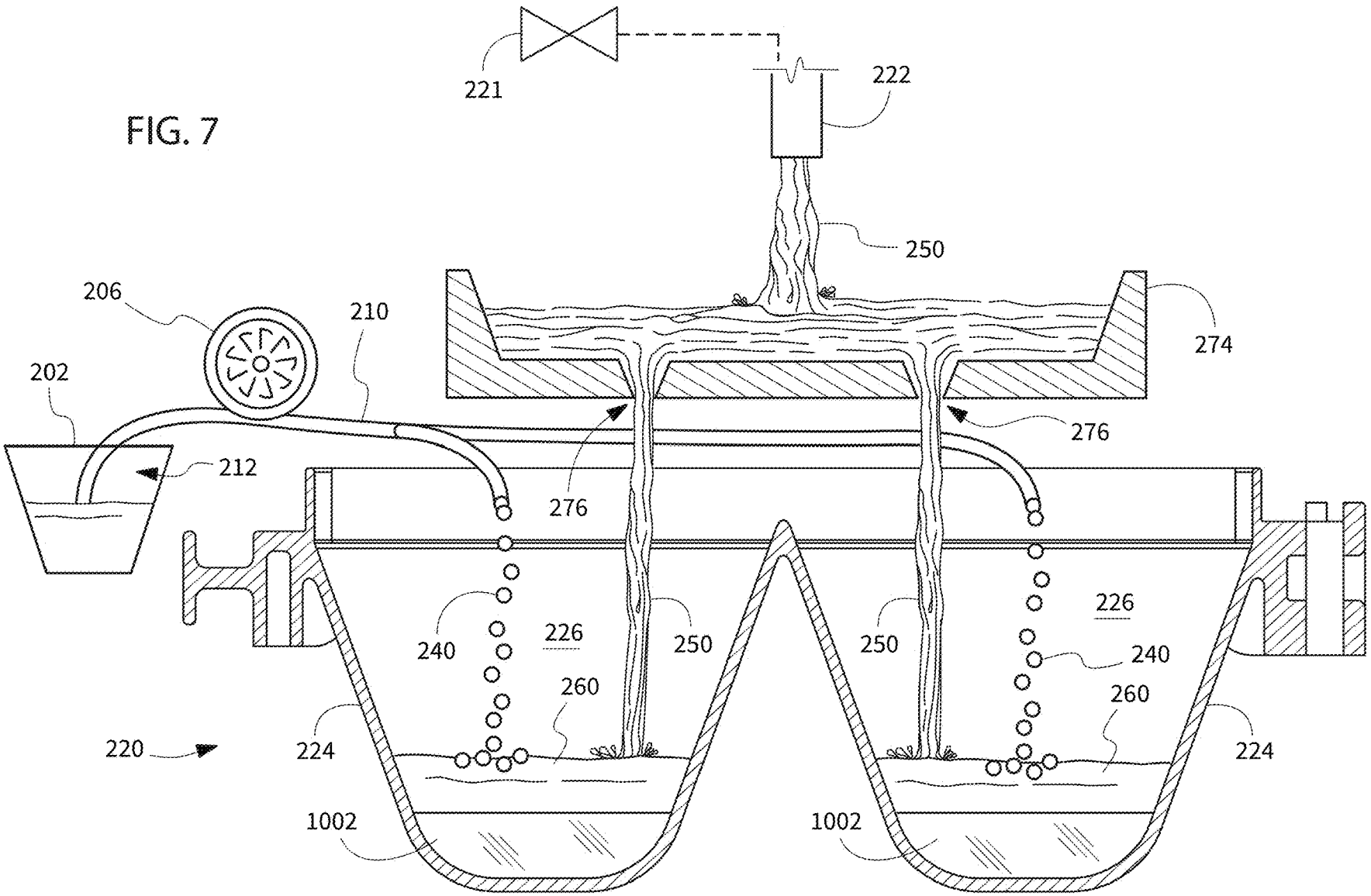
FIG. 7 provides another schematic view of the ice making assembly of FIG. 6.

Referring now to FIGS. 6 and 7, in some embodiments, the ice maker 200 may still include the fill cup 274, but the additive, e.g., the dispensing tube 210 which conveys the additive to the mold body 220, may bypass the fill cup 274. Such embodiments may provide easier cleaning, in that the fill cup 274 may not need to be cleaned (or at least not cleaned as frequently) when the additive is not flowed through the fill cup 274. In such embodiments, the dispensing tube 210 may include a first outlet 211 to provide additive 240 (FIG. 7) to a first one of the mold cavities 226 and a second outlet 213 to provide additive 240 (FIG. 7) to a second one of the mold cavities 226. The first and second outlets 211 and 213 of the dispensing tube 210 may be in direct fluid communication with each respective mold cavity 226, such that the liquid additive flows to each mold cavity 226 from each outlet 211, 213 without flowing through any intervening structures. Embodiments such as the exemplary embodiment illustrated in FIGS. 6 and 7 may be similar to the embodiments of FIGS. 4 and 5 described above, e.g., may be configured for flowing one or more various volumes of liquid simultaneously into each (e.g., both) of the mold cavities 226.

Figure 8:
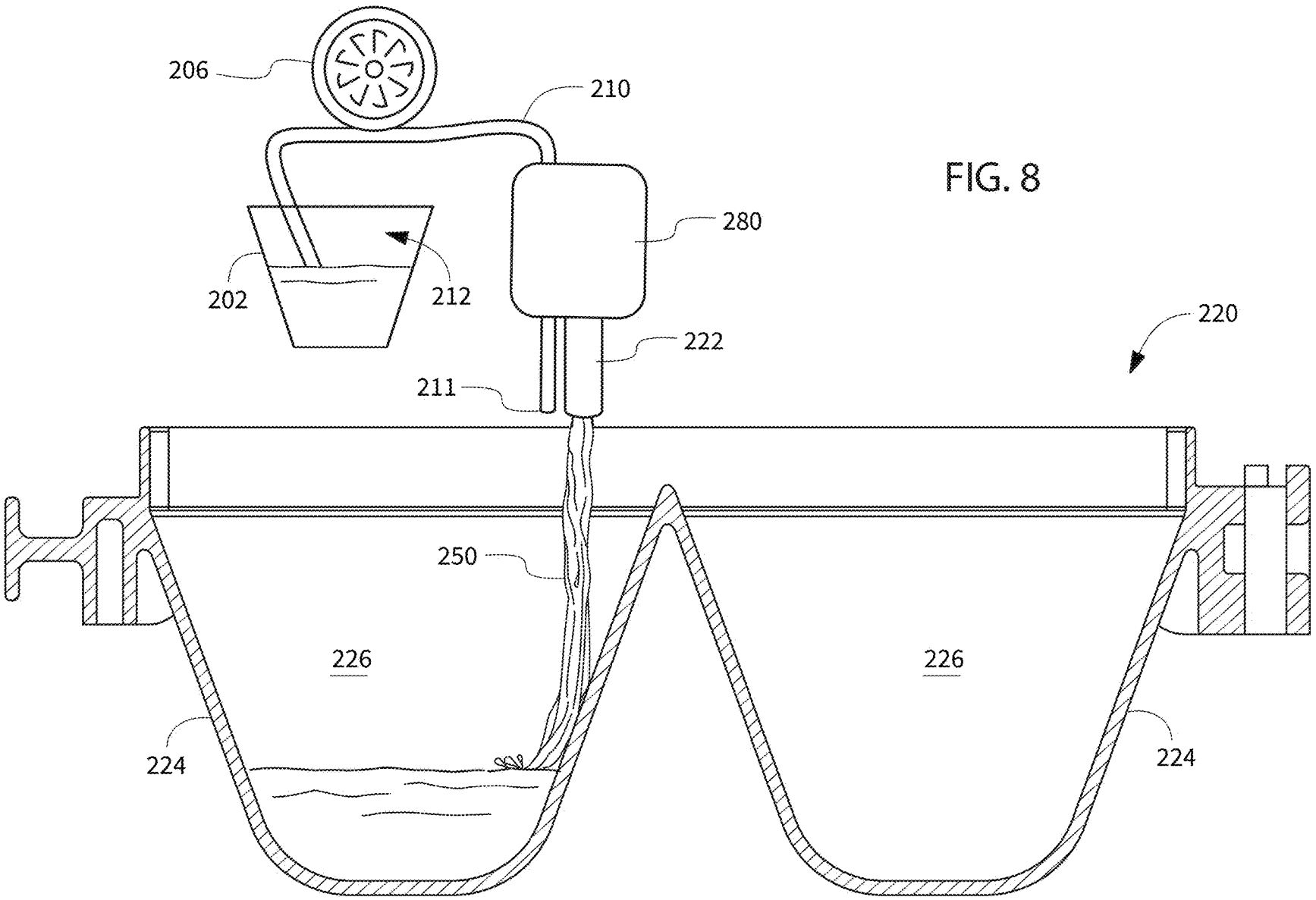
FIG. 8 provides a schematic illustration of an ice making assembly for an ice maker appliance, such as the exemplary refrigerator appliance of FIG. 1, in accordance with one or more additional exemplary embodiments of the present disclosure.
Figure 9:
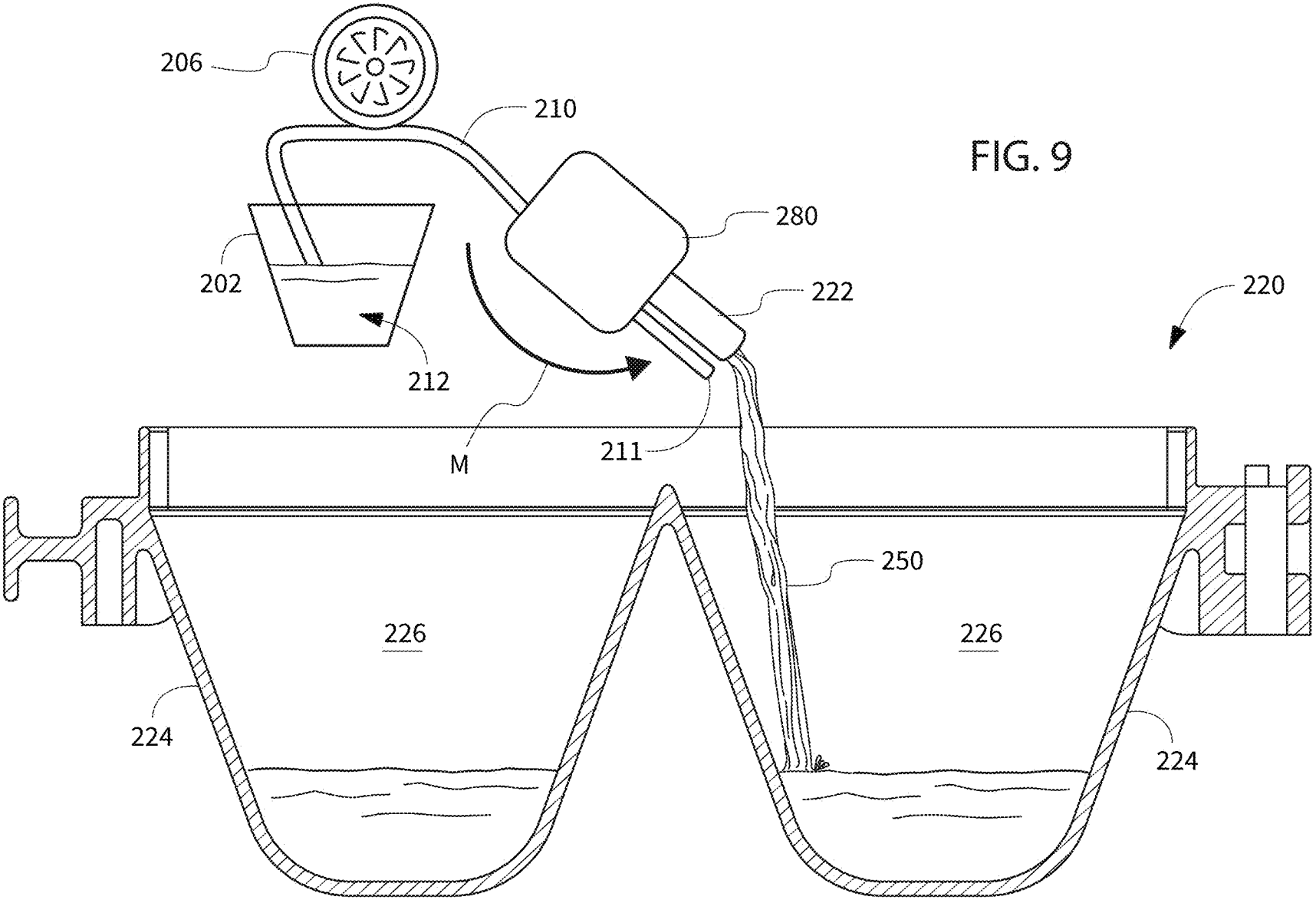
FIG. 9 provides another schematic view of the ice making assembly of FIG. 8.
Figure 10:
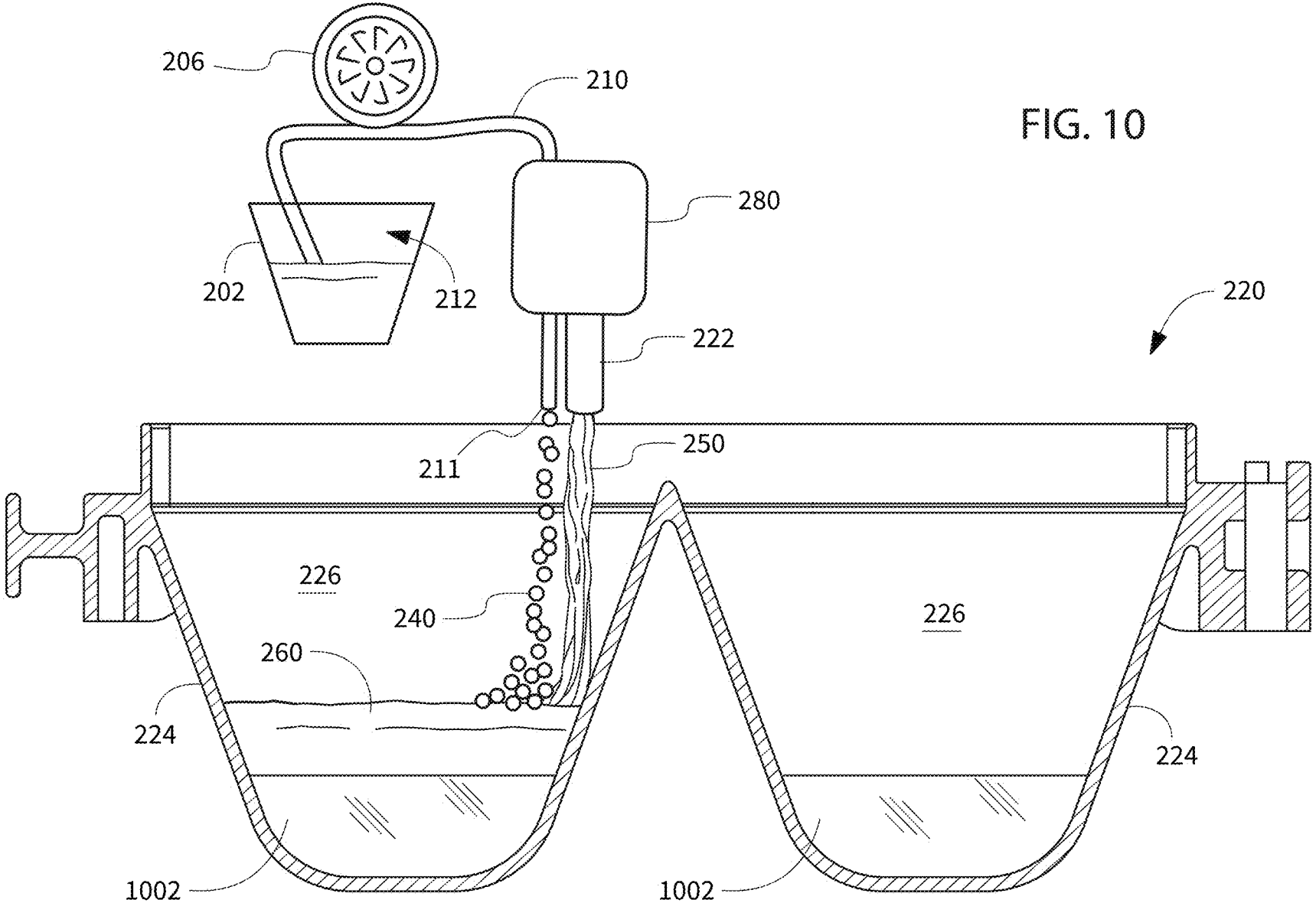
FIG. 10 provides another schematic view of the ice making assembly of FIG. 8.

In some embodiments, e.g., as illustrated in FIGS. 8, 9 and 10, the ice maker 200 may also include an actuator 280 coupled to the dispensing tube 210 and the fill tube 222. The actuator 280 may be operable to selectively move the dispensing tube and the fill tube between a first position and a second position. The dispensing tube 210 and the fill tube 222 may be positioned for directing a flow of at least one liquid from the dispensing tube 210 and the fill tube 222 (e.g., at least water 250 from the fill tube 222 or additive 240 from the dispensing tube 210, or both additive 240 from the dispensing tube 210 and water 250 from the fill tube 222) to a first mold cavity 226 of the two or more mold cavities 226 in the first position. The dispensing tube 210 and the fill tube 222 may be positioned for directing a flow of at least one liquid from the dispensing tube 210 and the fill tube 222 to a second mold cavity 226 of the two or more mold cavities 226 in the second position. For example, the actuator 280 may be or may include a motor, such as a wax motor. The wax motor, as is generally understood by those of ordinary skill in the art, may include a spring embedded in wax and a heater, where the heater causes the wax to melt when the heater is activated, such that the spring is then freed to move to a second position toward which the spring is biased. The components of the wax motor, being understood by those of ordinary skill in the art, are not specifically illustrated or described in further detail herein for the sake of brevity and clarity.

In embodiments where the actuator 280 is provided, the first volume of liquid may be provided in a first proportion (e.g., half in embodiments which include two mold cavities 226, e.g., as illustrated in FIGS. 8-10) to a first one of the mold cavities 226, as shown in FIG. 8. Turning now to FIG. 9, the actuator 280 may then move the dispensing tube 210 and the fill tube 222 (e.g., such motion indicated by arrow M in FIG. 9) to a second position, from which a second proportion of the first volume of liquid may be provided to a second mold cavity 226. As illustrated in FIG. 10, the dispensing tube 210 and the fill tube 222 may be returned to the first position, e.g., when the wax of the wax motor resolidifies after the heater is deactivated in embodiments where the actuator 280 is provided as a wax motor. After returning to the first position (and after retaining at least the first proportion of the first volume of liquid long enough to freeze), a first proportion of the second volume of liquid may be provided to the first mold cavity 226, e.g., where the second volume of liquid is the mixture 260 as illustrated in FIG. 10. Thus, it will be understood that the actuator may again move the dispensing tube 210 and the fill tube 222 to the second position in order to provide a second proportion of the second volume of liquid to the second mold cavity 226 (e.g., after the second proportion of the first volume of liquid has been retained in the mold body 220 long enough to freeze and thereby complete formation of the first layer of each ice piece in the exemplary two mold cavities 226). Also, in embodiments where more than two mold cavities are provided, the actuator 280 may be operable to move the dispensing tube 210 and the fill tube 222 to a third position, to provide one or more liquids to a third mold cavity 226, etc.

Additionally, in some embodiments the actuator 280 may be used to provide a single volume of mixed liquid to each mold cavity 226. For example, the dispensing tube 210 and the fill tube 222 may completely fill a first mold cavity 226 with a mixture of liquid water and additive, such as a mixture including a concentration of additive that is based on or determined from a user input, as will be further described below, and then move to the second position in order to completely fill a second mold cavity 226 with the same concentration of additive and liquid water. Thus, a first single-layer enhanced ice piece may be formed in the first mold cavity and a second single-layer enhanced ice piece may be formed in the second mold cavity by retaining the mixture of liquid water and additive in the mold cavities as described.

Various exemplary enhanced ice pieces 1000 which may be formed using ice makers 200 and/or methods of operating an ice maker according to various embodiments of the present disclosure are illustrated in FIGS. 11A, 11B, 11C, and 11D. As noted above, some such ice piece may have two or more distinct layers, and such layers may be distinct as a result of differences in the liquid provided in the first volume of liquid and the second volume of liquid, differences in the volume of the first volume of liquid and the second volume of liquid, and/or differences in the length of time that each volume of liquid is retained in the mold body. For example, any two of the foregoing may be varied, or all three may be varied, or only one may be varied, in order to form the distinct layers from the two or more volumes of liquid.

Figure 11A:
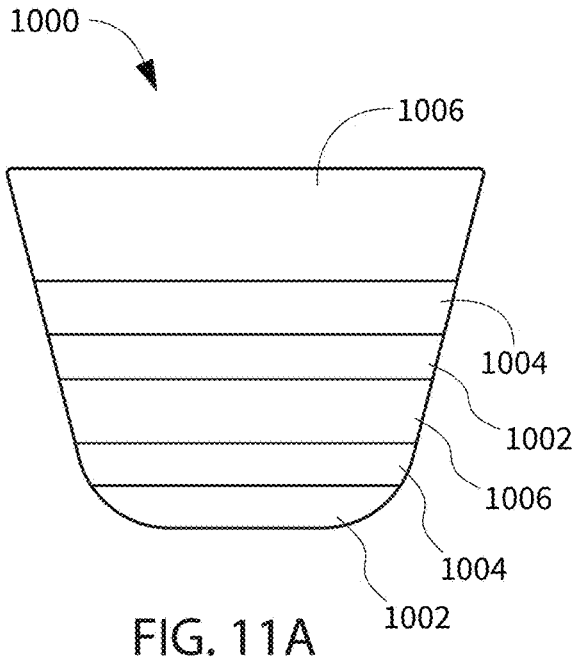
FIG. 11A illustrates an exemplary ice piece which may be formed by exemplary ice making appliances and/or exemplary methods of operating ice maker appliances according to one or more exemplary embodiments of the present disclosure.
Figure 11B:
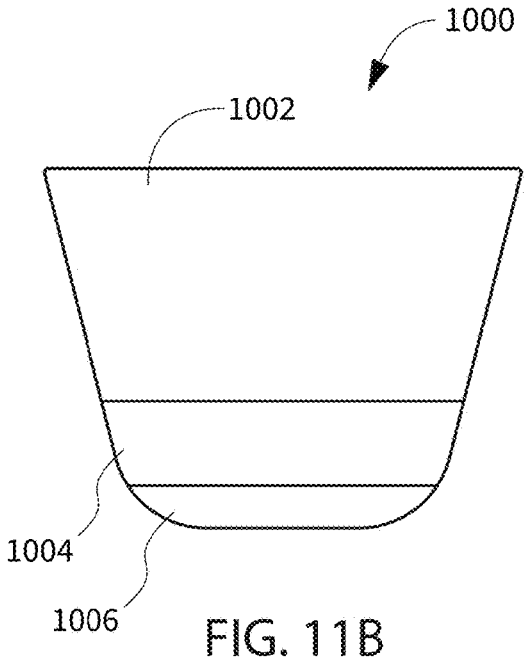
FIG. 11B illustrates another exemplary ice piece which may be formed by exemplary ice making appliances and/or exemplary methods of operating ice maker appliances according to one or more exemplary embodiments of the present disclosure.
Figure 11C:
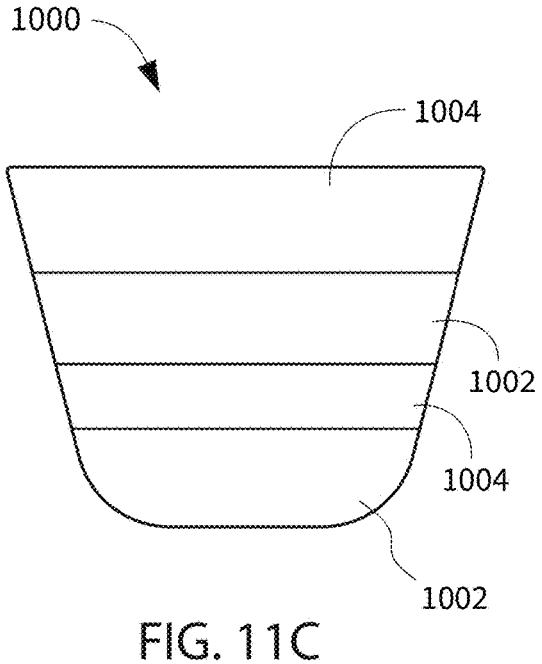
FIG. 11C illustrates another exemplary ice piece which may be formed by exemplary ice making appliances and/or exemplary methods of operating ice maker appliances according to one or more exemplary embodiments of the present disclosure.
Figure 11D:
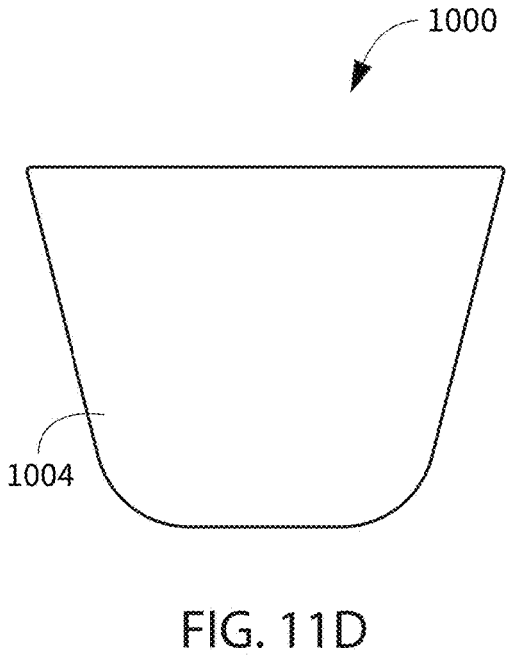
FIG. 11D illustrates another exemplary ice piece which may be formed by exemplary ice making appliances and/or exemplary methods of operating ice maker appliances according to one or more exemplary embodiments of the present disclosure.

The number and size of layers may vary. For example, as may be seen from FIGS. 11A-11C generally, the two or more distinct layers may include three layers (see, e.g., FIG. 11B), four layers (see, e.g., FIG. 11C), or more than four layers, such as six layers as illustrated in FIG. 11A. Also as may be seen throughout FIGS. 11A-11C, the size, e.g., thickness or height, of the layers may be equal or may differ, or, in embodiments with at least three layers, some layers may be the same size while other layers have a different size. As may be seen, e.g., in FIG. 11D, in some embodiments, the ice piece 1000 may include a single mixed layer 1004.

As illustrated in FIG. 11A, the ice piece 1000 may include a water layer 1002 (which may also be referred to as a plain layer, and which may be a clear layer or a cloudy later, e.g., based on the predetermined amount of time for which the water was retained in the mold cavity to form the layer), e.g., the first layer may be a water layer 1002. The second layer of the ice piece 1000 may be a first mixed layer 1004, e.g., may be formed from a volume liquid that included both additive and water mixed together in a first ratio, e.g., with a first concentration of additive. Also as shown in FIG. 11A, the ice piece 1000 may include a second mixed layer 1006. For example, the first mixed layer 1004 may include a first concentration of additive, and the second mixed layer 1006 may include a second concentration of additive which is different from the first concentration. In some embodiments, the pattern of layers may be repeated, e.g., as illustrated in FIG. 11A. For example, as illustrated in FIG. 11A, the layers may begin with a pattern of clear water layer 1002, first mixed water and additive layer 1004, and second mixed water and additive layer 1006, with three additional layers in the same order.

In additional embodiments, the pattern of layers may vary or be asymmetrical. For example, the first (bottommost) layer may be a second mixed layer 1006 (having the second concentration of additive), followed by a first mixed layer 1004 (having the first concentration of additive), then the water ice layer 1002, another first mixed layer 1004, another second mixed layer 1006, and finally another water ice layer 1002, among numerous other possible asymmetrical patterns of different layers. As another example, any of the foregoing layer number, size, and/or proportions may be provided in various combinations.

Figure 12:
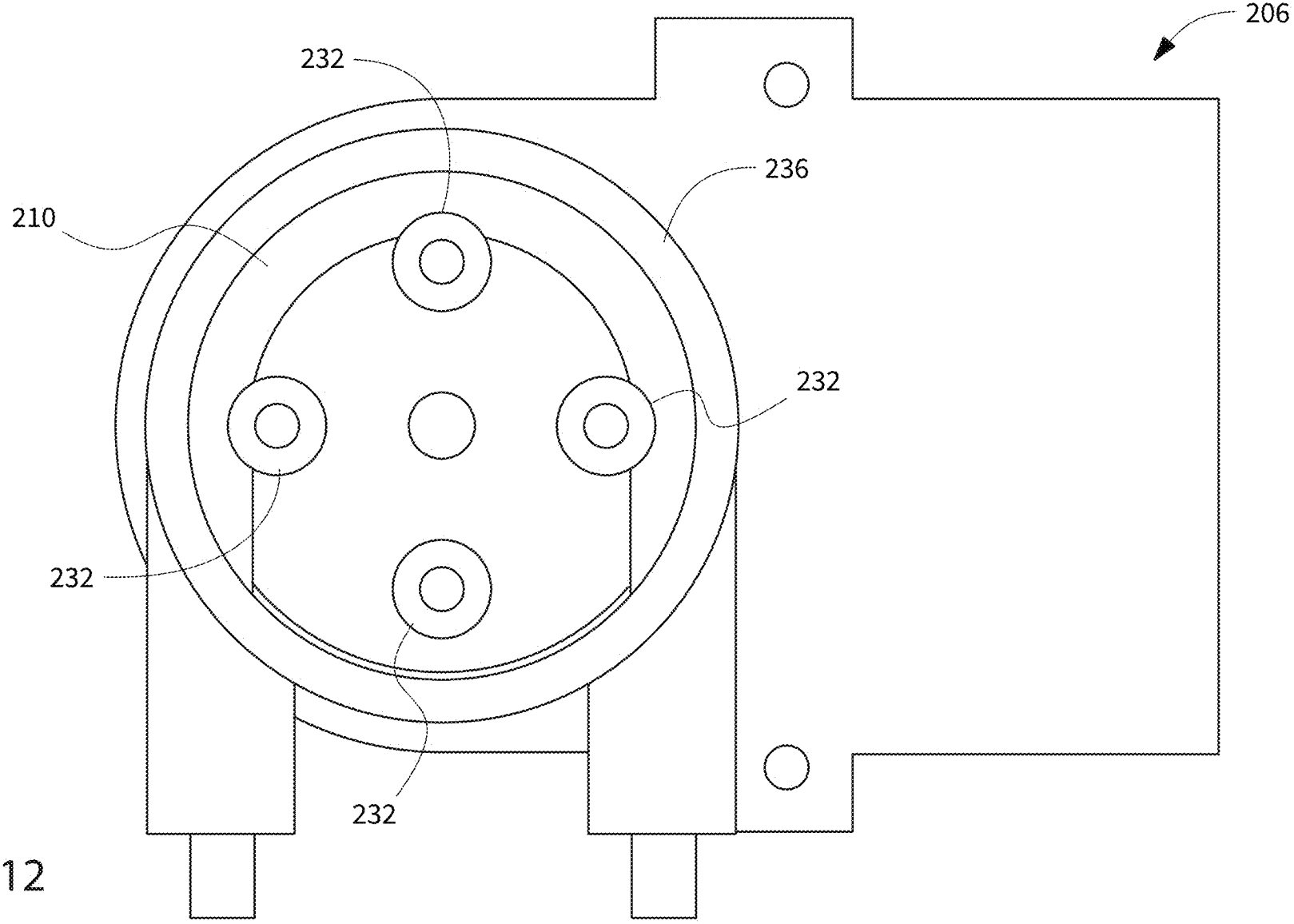
FIG. 12 provides a front elevation view of an exemplary dosing pump for an ice making assembly such as the exemplary ice making assembly of FIG. 4.
Figure 13:
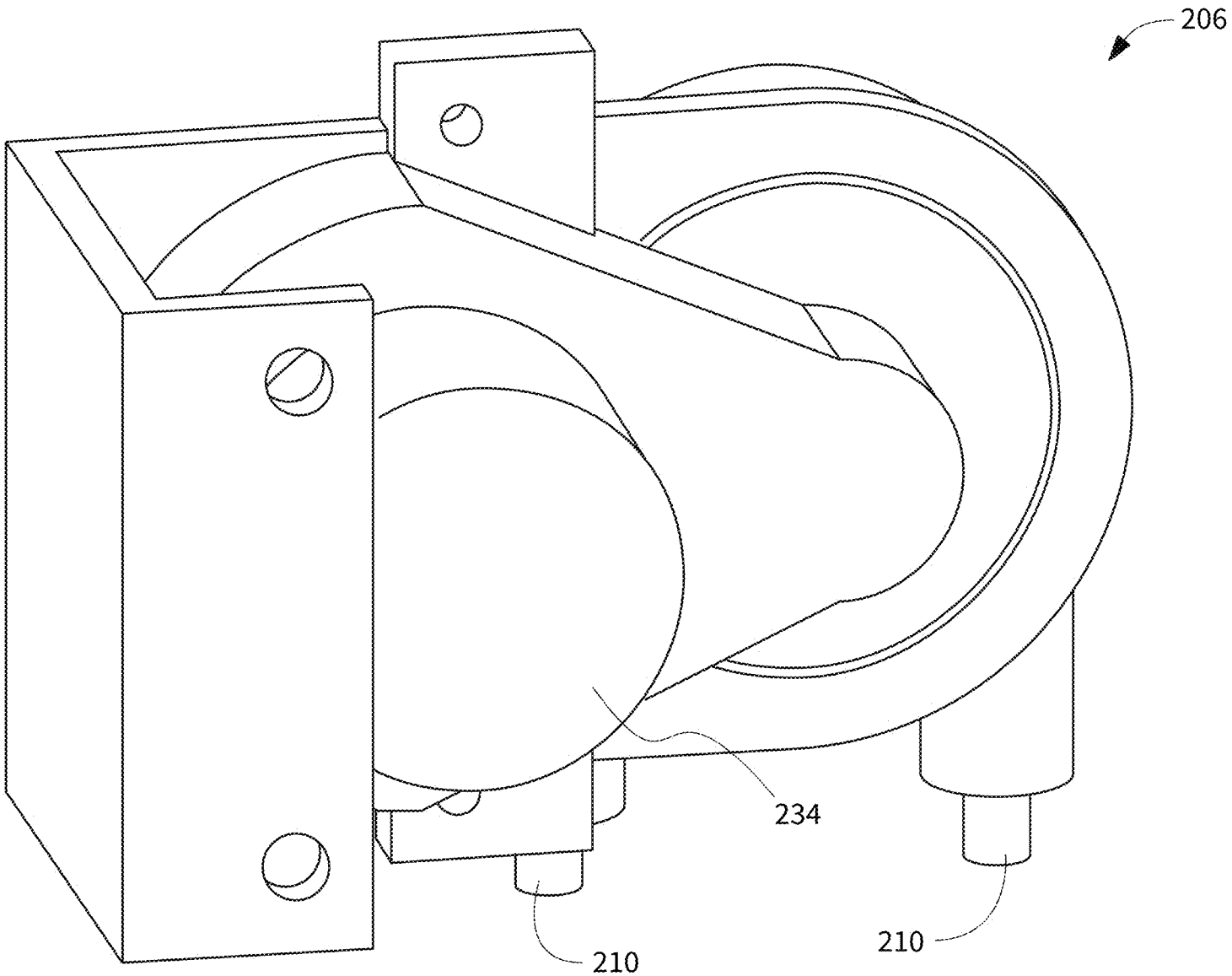
FIG. 13 provides a rear perspective view of the exemplary dosing pump of FIG. 12.

Referring now to FIGS. 12 and 13, in some embodiments, the dosing pump 206 may be a peristaltic pump. For example, a segment of the dispensing tube 210 may extend through a housing 236 of the peristaltic pump 206, and the peristaltic pump 206 may include a plurality of rollers 232, each of which compresses a portion of the dispensing tube 210 between the roller 232 and the housing 236. The peristaltic pump 206 may further include a motor 234 (FIG. 13), such as a stepper motor, which is operable to rotate the rollers 232 within the housing 236 such that the rollers 232 progressively and sequentially compress portions of the dispensing tube 210, thereby urging the additive from the additive receiver 202 through the dispensing tube 210 and to the mold body 220.

Figure 14:
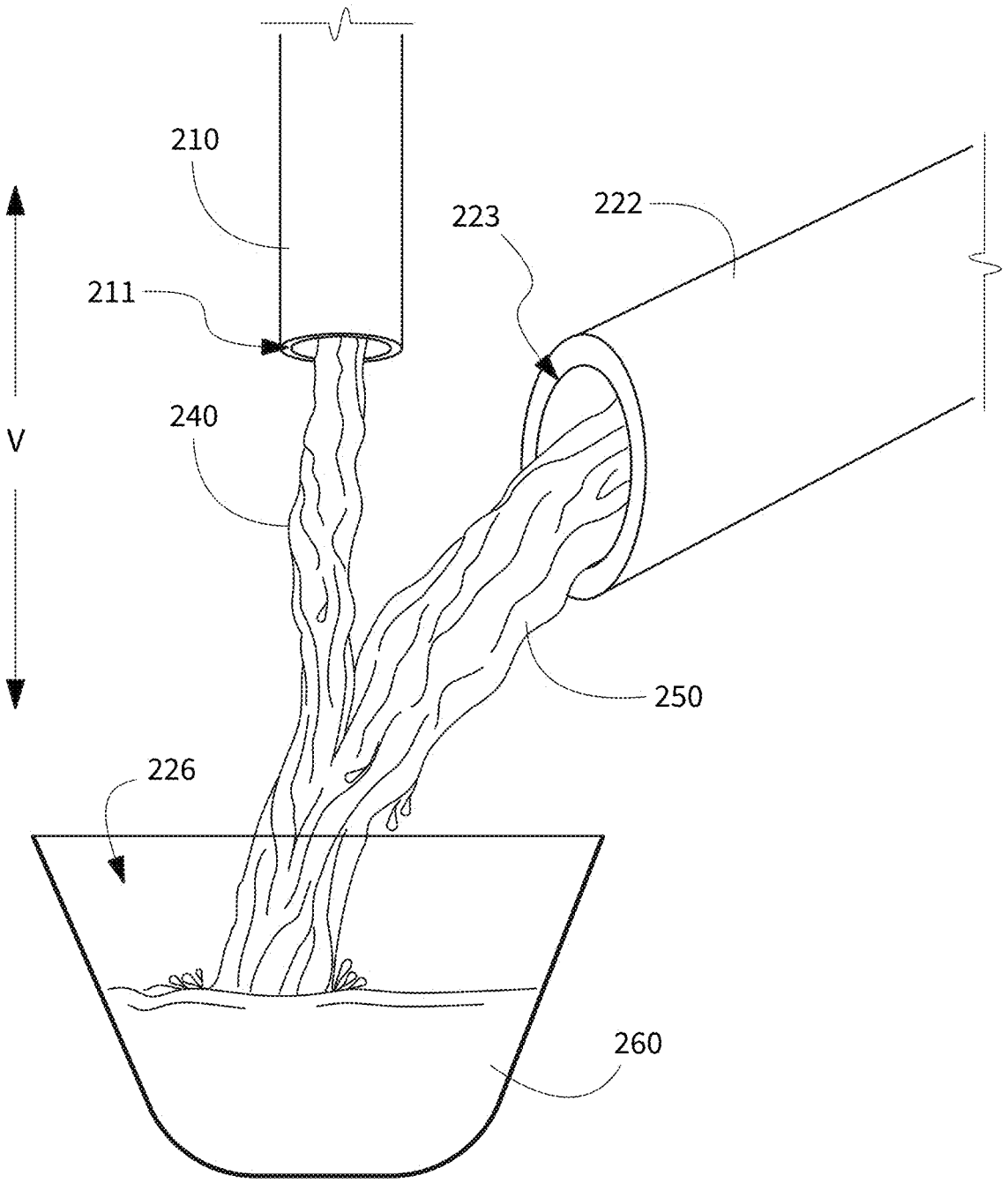
FIG. 14 provides a schematic illustration of an exemplary dispensing tube and an exemplary fill tube, along with exemplary liquid streams associated with each tube, as may be incorporated into an ice maker appliance or ice making assembly in accordance with one or more embodiments of the present disclosure.

In some embodiments, e.g., as illustrated in FIG. 14, the additive and the liquid water may mix at least partially in the mold cavity 226. For example, in FIG. 14, an end portion of the dispensing tube 210 and a stream of additive 240 emanating from an outlet 211 of the dispensing tube 210 are illustrated, as well as an end portion of the water fill tube 222 with a stream of water 250 emanating from an outlet 223 of the water fill tube 222. As may be seen in FIG. 14, the water fill tube 222 may be oriented at an oblique angle to the vertical direction V, such that the stream of water 250 (which flows to the water fill tube 222 at a generally constant pressure from one or more valves (e.g., fill valve 221 described above) within the refrigerator appliance 100 (or other ice maker appliance) and upstream of the water fill tube 222) defines an arcuate path outward from the end portion of the water fill tube 222 and downward along the vertical direction V under the combined influence of the upstream water pressure as the stream of water 250 exits the water fill tube 222 and the force of gravity on the stream of water 250.

The end portion of the fill tube 210 may be oriented generally along or parallel to the vertical direction V, such that the stream of additive 240 from the dispensing tube 210 flows generally straight down. In some embodiments, the end portion of the fill tube 210 may be centered over the center of the mold cavity 226. The end portion of the dispensing tube 210 may be positioned directly in front of the end portion of the fill tube 222, e.g., along the flow direction of the stream of water 250. The outlet 211 of the dispensing tube 210 may be positioned above the outlet 223 of the fill tube 222. The outlet 211 of the dispensing tube 210 may be offset from the outlet 223 of the fill tube 222 generally along a horizontal direction, e.g., a direction perpendicular to the vertical direction V. The end portion of the dispensing tube 210 may be aligned along a tangent to the arcuate stream of water 250 from the fill tube 222. The stream of additive 240 and the stream of water 250 may intersect in the air, e.g., above the mold cavity 226, forming a mixture 260 of water and additive. The mixture 260 may be generated at least in part due to the intermixing of the streams 240 and 250 outside of (e.g., above) the mold cavity 226 and at least in part due to kinetic energy of the falling stream as the liquid lands in the mold cavity 226. Thus, the outlet 211 of the dispensing tube 210 may be aligned with the outlet 223 of the fill tube 222 such that the flow of the liquid additive from the dispensing tube 210 mixes with the flow of liquid water from the fill tube 222 to form a mixed flow of liquid water and liquid additive.

As may be seen in FIG. 14, the size, e.g., inner diameter, of the dispensing tube 210 may be less than, such as about half of or less than half of, the size, e.g., inner diameter, of the fill tube 222. Additionally, the dosing pump may be configured to provide a relatively slow velocity (e.g., low pressure) flow of additive through the dispensing tube 210. Thus, the rate of flow of the stream of additive 240 may be much lower than the rate of flow of the stream of water 250, such as the stream of additive 240 may be much smaller and slower than the stream of water 250. For example, the flows may be synchronized, such that the flow time during a fill is the same for both streams, while the stream of additive 240 may be much smaller and slower such that the additive may, in some embodiments, account for about five percent (%%) of the mixture 260 or less, such as about three percent (3%) or less, such as about 1.5% or less, such as about 1% or less, such as about 0.5% or less.

Accordingly, the mold body 220, e.g., the one or more mold cavities 226 therein, may be positioned downstream of the dispensing tube 210 and downstream of the fill tube 222. The mold cavity 226 may be configured for receiving the mixed flow of liquid water and liquid additive such that the mixture 260 of liquid water and liquid additive is formed at least partially in the mold cavity 226, e.g., the mixture 260 may be partially formed outside of the mold cavity 226 as the liquid flows to the mold cavity 226 and further mixing may occur in the mold cavity 226. The mold cavity 226 may be further configured for retaining the mixture 260 of liquid water and liquid additive to form an ice piece (or at least a portion, e.g., layer, thereof) from the mixture 260 in the mold cavity.

The mold cavities 226 in the mold body 220 may be relatively fewer in number and may be larger than typical mold cavities of a conventional, e.g., plain water, ice maker. For example, the ice making assembly 200 may include only four or fewer mold cavities, such as only two mold cavities (as illustrated) or only one mold cavity. The relatively large and deep mold cavity 226 (e.g., as compared to mold cavities of typical plain ice makers) may contain the mixture 260 and promote mixing thereof while minimizing splashing or spilling of the mixture 260 from the mold cavity 226.

In some embodiments, in particular embodiments where the mold body 220 is or is a part of a twist tray for automatically harvesting the ice pieces, mixing of the water and additive may also be promoted by rocking the mold body 220 back and forth, e.g., using rotors which are coupled to the mold body 220 for rotating the mold body 220 by about one hundred and eighty degrees (180°) in order to dump ice pieces from the mold body 220 into the ice bin 230, where the rocking motion may include a lesser degree of rotation in a back-and-forth oscillatory manner such that the water and additive are mixed within the mold body 220 without spilling out of the mold body 220. For example, the rotor may be a part of, or may be coupled to, a harvest motor which is actuated to harvest ice pieces from the mold body 220. The harvest motor may be a DC motor which is selectively rotatable in a first direction, e.g., clockwise, or a second direction opposite the first direction, e.g., counter-clockwise, depending on the polarity of the DC power supplied to the harvest motor. Thus, for example, the harvest motor may be operable to twist the mold body 220 to release ice pieces from the mold body 220 and then may be operable to rotate the mold body 220, e.g., by about one hundred and eighty degrees (180°) as mentioned, to transfer the released ice pieces from the mold body 220 into a storage bin therebelow. Similarly, the harvest motor may be operable to provide the rocking motion to the mold body 220 in order to promote mixing, such as by switching (e.g., reversing) the polarity of DC power supplied to the harvest motor.

Figure 15:
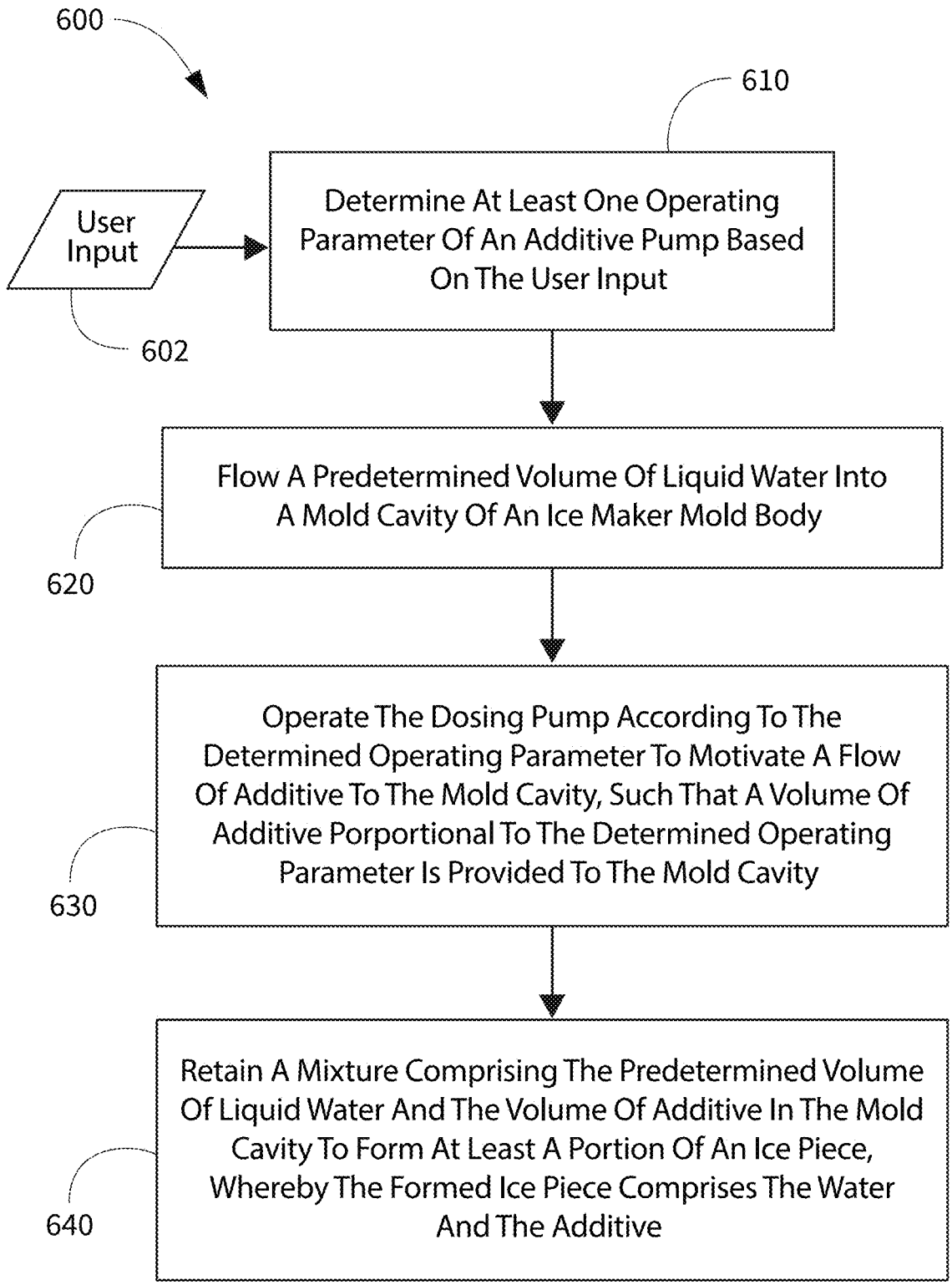
FIG. 15 provides a flow chart diagram of an exemplary method of operating an ice maker appliance according to one or more further exemplary embodiments of the present disclosure.

Turning now to FIG. 15, embodiments of the present disclosure may also include methods of operating an ice maker appliance, such as the exemplary method 600 illustrated in FIG. 15. Such methods may be used with any suitable ice maker appliance, for example but not limited to the exemplary refrigerator appliance 100 and/or ice maker 200 described above. Thus, for example, the ice maker appliance may include a mold body comprising a mold cavity, a fill tube operable to provide a flow of liquid water to the mold cavity, and a dosing pump operable to motivate a flow of additive to the mold cavity.

As illustrated in FIG. 15, in some embodiments, methods according to the present disclosure such as method 600 may include receiving a user input (602) and (610) determining at least one operating parameter for a dosing pump based on the user input. For example, the user input may be a desired additive concentration, and the at least one operating parameter of the dosing pump may be determined to provide a volume of additive which, when mixed with a volume of liquid water, will result in an ice piece (and/or a layer of the ice piece) having the desired additive concentration as indicated by the user input. In various embodiments, the user input may indicate the desired concentration of additive qualitatively (e.g., high or low) or quantitatively (e.g., by entering a percentage of additive).

Method 600 may also include (620) flowing the volume of liquid water from the fill tube to the mold cavity. In some embodiments, the volume of liquid water may be a predetermined volume. In additional embodiments, the volume of liquid water may also be determined based on the user input. The volume of liquid water may be provided and flowed to the mold cavity by opening a fill valve (e.g., valve 221), and the volume may be controlled based on how long the fill valve is opened.

Method 600 may further include (630) operating the dosing pump according to the determined operating parameter to motivate a flow of additive to the mold cavity. The operating parameter may include one or more of pump speed, pumping time, and/or a number of iterations of a pumping operation that provides predefined volume of additive in each operation. As noted, the operating parameter may be based on the user input. As a result of operating the dosing pump according to the determined operating parameter, a volume of additive is provided to the mold cavity, and the volume of additive may be proportional to the operating parameter of the dosing pump and/or defined by the operating parameter.

Method 600 may also include (640) retaining a mixture comprising the volume of liquid water and the volume of additive proportional to the operating parameter of the dosing pump in the mold cavity to form at least a portion of an ice piece, such as an entire ice piece or one layer of a multi-layer ice piece. Thus, the formed ice piece is an enhanced ice piece, e.g., includes the water and the additive, such as at least one layer of the ice piece includes the water and the additive.

In some embodiments, the volume of liquid water at (620) may be a first volume of liquid water. In such embodiments, the portion of the ice piece may be a first layer of the ice piece, and the method may further include flowing a second volume of liquid water to the mold cavity after forming the first layer of the ice piece, and the second volume of liquid may be mixed with additive (e.g., in a different concentration from the first layer) or which may be water only. Such embodiments may also include retaining the second volume of liquid water in the mold cavity to form a second layer of the ice piece. As a result, the ice piece includes the first layer and the second layer. The first layer of the ice piece may include a first concentration of the additive and the second layer of the ice piece may include a second concentration of the additive, the second concentration is different from the first concentration, and the second concentration may, in some embodiments, be zero, e.g., the second layer may be a plain water layer.

In some embodiments, the operating parameter based on the user input may be or may include a speed of the dosing pump. Thus, operating the dosing pump comprises may include operating the dosing pump at the speed to motivate the flow of additive to the mold cavity, and the volume of additive (and thus the concentration of the additive in the resultant ice piece or layer) may be proportional to the speed of the dosing pump.

In some embodiments, the operating parameter based on the user input may be or may include a dosing time. Thus, operating the dosing pump may include operating the dosing pump to motivate the flow of additive to the mold cavity for the dosing time. Accordingly, the volume of additive (and thus the concentration of the additive in the resultant ice piece or layer) may be proportional to the dosing time.

In some embodiments, the operating parameter based on the user input may be or may include a number of flows of additive, e.g., each flow of additive may include a predefined volume of additive and the flow operation may be repeated to provide a higher concentration of additive when such a higher concentration of additive is selected, e.g., by the user input. For example, one flow of additive may provide a low concentration, two flows of additive may provide a medium concentration, and three flows of additive may provide a high concentration. For example, each flow of additive may provide about 1% additive concentration, such that the low concentration is about 1%, the medium concentration is about 2%, and the high concentration is about 3%. In additional examples, each flow may provide any suitable increment of concentration, such as about 0.5%, or about 0.75%, or about 1.5%, among other possible concentrations provided in each flow. In such embodiments, operating the dosing pump may include operating the dosing pump to motivate the number of flows of additive to the mold cavity, and thus the number of flows may collectively define the volume of additive provided to the mold cavity.

In some embodiments, the user input may include a selection of one of a plurality of predefined additive concentration levels. For example, the predefined additive concentration levels may be low concentration and high concentration, and may also include a medium concentration between the low concentration and the high concentration. Other similar qualitative options may be provided, such as mild, strong, ultra, and other similar descriptors of various additive concentration levels.

In additional embodiments, the user input may include a concentration value, such as the user input may simply be the desired concentration, e.g., as a percentage, of additive in the final ice piece. For example, the selectable concentration value may be a range between about one half percent (0.5%) and about ten percent (10%) additive in the final ice piece or layer, such as up to about seven percent (7%) additive in the final ice piece or layer, or up to about five percent (5%) additive in the final ice piece or layer, including any intermediate value within the selectable range.

In some embodiments, the user input may be received from a local user interface of the ice maker appliance, e.g., control panel 160.

In some embodiments, the user input may also or instead be received from a remote user interface device. The remote user interface device may be in communication with the ice maker appliance wirelessly, e.g., through various possible communication connections and interfaces. The ice maker appliance and the remote user interface device may be matched in wireless communication, e.g., connected to the same wireless network. The ice maker appliance may communicate with the remote user interface device via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the appliance and the remote user interface device. For example, BLUETOOTH® Low Energy may advantageously minimize the power consumed by the exemplary methods and devices described herein due to the low power networking protocol of BLUETOOTH® Low Energy. The remote user interface device is "remote" at least in that it is spaced apart from and not physically connected to the ice maker appliance, e.g., the remote user interface device is a separate, stand-alone device from the ice maker appliance which communicates with the ice maker appliance wirelessly. Any suitable device separate from the ice maker appliance that is configured to provide and/or receive communications, information, data, or commands from a user may serve as the remote user interface device, such as a smartphone, smart watch, personal computer, smart home system, or other similar device. For example, the remote user interface device may be a smartphone operable to store and run applications, also known as "apps," and some or all of the method steps disclosed herein may be performed by a smartphone app. The remote user interface device may include a memory for storing and retrieving programming instructions. Thus, the remote user interface device may provide a remote user interface which may be an additional user interface to the control panel 160. For example, the remote user interface device may be a smartphone operable to store and run applications, also known as "apps," and the remote user interface may be provided as a smartphone app.

Figure 16:
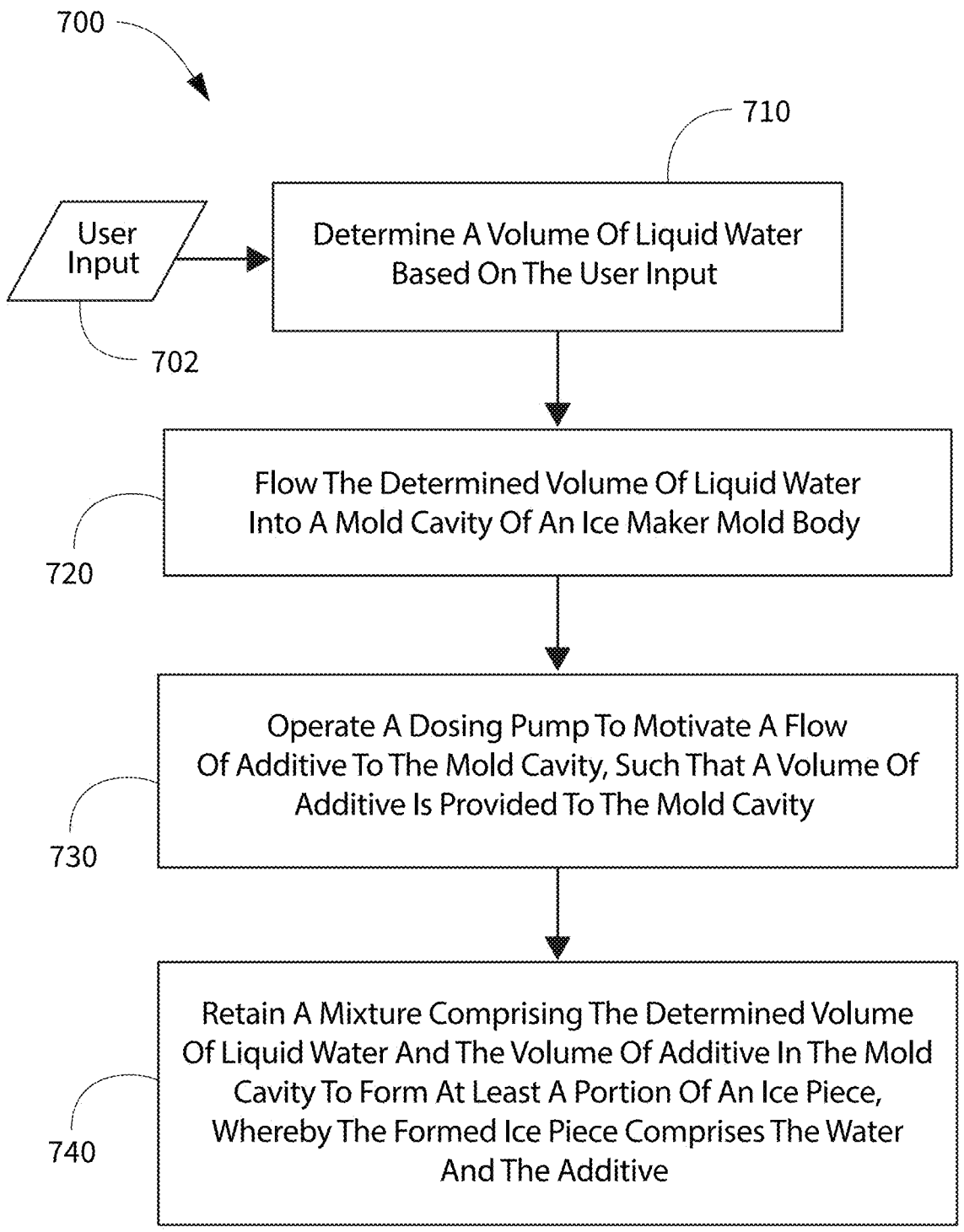
FIG. 16 provides a flow chart diagram of another exemplary method of operating an ice maker appliance according to one or more further exemplary embodiments of the present disclosure.

Another exemplary method 700 of operating an ice maker appliance is illustrated in FIG. 16. The ice maker appliance may include a mold body with a mold cavity, a fill tube operable to provide a flow of liquid water to the mold cavity, and a dosing pump operable to motivate a flow of additive to the mold cavity. As illustrated in FIG. 16, the method 700 may include receiving a user input (702) and (710) determining a volume of liquid water based on the user input. For example, the volume of water may be controlled by opening a fill valve for a determined time to provide the determined volume of water given a known steady flow rate of water, e.g., from a fill tube of the ice maker appliance. Accordingly, a concentration of additive in an ice piece or a layer of an ice piece formed according to the method 700 may be proportional to the determined volume of water, e.g., inversely proportional such as the greater the volume of water the lower the concentration of additive in the finished ice piece or layer.

Method 700 may further include (720) flowing the determined volume of liquid water from the fill tube to the mold cavity, such as opening a fill valve to permit the water to flow from the fill tube as described above. Method 700 may also include (730) operating the dosing pump to motivate a flow of additive to the mold cavity, which causes a volume of additive to be provided to the mold cavity.

Method 700 may also include (740) retaining a mixture comprising the determined volume of liquid water and the volume of additive in the mold cavity to form at least a portion of an ice piece, e.g., at least one layer of a multi-layer ice piece or an entire single layer ice piece. Thus, the formed ice piece comprises the water and the additive.

In some embodiments, (730) operating the dosing pump may include operating the dosing pump to motivate the flow of additive to the mold cavity according to an operating parameter based on the user input. In such embodiments, the volume of additive provided to the mold cavity may thusly be proportional to the operating parameter of the dosing pump. In additional embodiments, (730) operating the dosing pump may include providing a fixed predetermined volume of additive, e.g., the volume of additive provided to the mold cavity may be a predetermined volume.

Referring now generally to FIGS. 15 and 16, the methods 600 and/or 700 may be interrelated and/or may have one or more steps from one of the methods 600 and 700 combined with the other method 600 or 700. Thus, those of ordinary skill in the art will recognize that the various steps of the exemplary methods described herein may be combined in various ways to arrive at additional embodiments within the scope of the present disclosure.

FIGS. 15 and 16 depict steps in a particular order for purpose of illustration and discussion. Those of ordinary skill in the art, using the disclosures provided herein, will understand that (except as otherwise indicated) methods 600 and 700 are not mutually exclusive. Moreover, the steps of the methods 600 and 700 can be modified, adapted, rearranged, omitted, interchanged, or expanded in various ways without deviating from the scope of the present disclosure.

Furthermore, the skilled artisan will recognize the interchangeability of various features from different embodiments. Similarly, the various method steps and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

Aspects of the present disclosure include systems and methods for making flavored ice, e.g., in a refrigerator appliance, a stand alone ice maker appliance, or other similar ice maker appliance, based on user selected concentration level such that the ice piece, or at least one layer thereof, includes a concentration of additive selected by the user. The ice maker appliance may include an additive dosing system for dosing additives such as flavors, colors, and/or other additives. This system allows a user to control the concentration level of flavor and color in the ice through a local user interface of the ice maker appliance or via a software application on a remote user interface device such as a smartphone, smart home system, or other similar device remote from the ice maker appliance and in wireless communication therewith. The concentration setting may include pre-set levels like low, medium, high, or custom levels, e.g., where the user may be permitted to directly input an additive concentration within a given range, for example, between about one half percent (0.5%) additive in the final ice piece or layer and about ten percent (10%) additive in the final ice piece or layer. When combining such systems and methods with multilayer ice making systems and methods, it is possible to have various multi-layer options with varying concentrations of additive in the multiple layers of the finished ice piece.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an ice maker appliance, the ice maker appliance comprising a mold body comprising a mold cavity, a fill tube operable to provide a flow of liquid water to the mold cavity, and a dosing pump operable to motivate a flow of additive to the mold cavity, the method comprising:

receiving a user input;

flowing a volume of liquid water from the fill tube to the mold cavity;

operating the dosing pump according to an operating parameter to motivate a flow of additive to the mold cavity from a dispensing tube, wherein the additive and liquid water are mixed outside of the fill tube and the dispensing tube, the operating parameter based on the user input, whereby a volume of additive proportional to the operating parameter of the dosing pump is provided to the mold cavity; and retaining a mixture comprising the volume of liquid water and the volume of additive proportional to the operating parameter of the dosing pump in the mold cavity to form at least a portion of an ice piece, whereby the formed ice piece comprises the water and the additive.

2. The method of claim 1, wherein the volume of liquid water is a first volume of liquid water, wherein the portion of the ice piece is a first layer of the ice piece, further comprising flowing a second volume of liquid water to the mold cavity after forming the first layer of the ice piece, and retaining the second volume of liquid water in the mold cavity to form a second layer of the ice piece, whereby the ice piece comprises the first layer and the second layer, the first layer of the ice piece comprising a first concentration of the additive and the second layer of the ice piece comprising a second concentration of the additive, the second concentration different from the first concentration.

3. The method of claim 1, wherein the operating parameter based on the user input comprises a speed of the dosing pump, wherein operating the dosing pump comprises operating the dosing pump at the speed to motivate the flow of additive to the mold cavity.

4. The method of claim 1, wherein the operating parameter based on the user input comprises a dosing time, wherein operating the dosing pump comprises operating the dosing pump to motivate the flow of additive to the mold cavity for the dosing time.

5. The method of claim 1, wherein the operating parameter based on the user input comprises a number of flows of additive, wherein operating the dosing pump comprises operating the dosing pump to motivate the number of flows of additive to the mold cavity, whereby the number of flows collectively define the volume of additive provided to the mold cavity.

6. The method of claim 1, wherein the volume of liquid water is a predetermined volume of liquid water.

7. The method of claim 1, wherein the volume of liquid water is determined based on the user input.

8. The method of claim 1, wherein the user input comprises a selection of one of a plurality of predefined additive concentration levels.

9. The method of claim 1, wherein the user input comprises a concentration value.

10. The method of claim 1, wherein the user input is received from a local user interface of the ice maker appliance.

11. The method of claim 1, wherein the user input is received from a remote user interface device.

12. A method of operating an ice maker appliance, the ice maker appliance comprising a mold body comprising a mold cavity, a fill tube operable to provide a flow of liquid water to the mold cavity, and a dosing pump operable to motivate a flow of additive to the mold cavity, the method comprising:

receiving a user input;

determining a volume of liquid water based on the user input;

flowing the determined volume of liquid water from the fill tube to the mold cavity;

operating the dosing pump to motivate a flow of additive to the mold cavity from a dispensing tube;

mixing the liquid water and the additive outside of the fill tube and the dispensing tube, whereby a volume of additive is provided to the mold cavity; and retaining a mixture comprising the determined volume of liquid water and the volume of additive in the mold cavity to form at least a portion of an ice piece, whereby the formed ice piece comprises the water and the additive.

13. The method of claim 12, wherein the determined volume of liquid water is a first volume of liquid water, wherein the portion of the ice piece is a first layer of the ice piece, further comprising flowing a second volume of liquid water to the mold cavity after forming the first layer of the ice piece, and retaining the second volume of liquid water in the mold cavity to form a second layer of the ice piece, whereby the ice piece comprises the first layer and the second layer, the first layer of the ice piece comprising a first concentration of the additive and the second layer of the ice piece comprising a second concentration of the additive, the second concentration different from the first concentration.

14. The method of claim 12, wherein operating the dosing pump comprises operating the dosing pump to motivate the flow of additive to the mold cavity according to an operating parameter based on the user input, whereby the volume of additive provided to the mold cavity is proportional to the operating parameter of the dosing pump.

15. The method of claim 12, wherein the volume of additive provided to the mold cavity is a predetermined volume.

16. The method of claim 12, wherein the user input comprises a selection of one of a plurality of predefined additive concentration levels.

17. The method of claim 12, wherein the user input comprises a concentration value.

18. The method of claim 12, wherein the user input is received from a local user interface of the ice maker appliance.

19. The method of claim 12, wherein the user input is received from a remote user interface device.

* * * * *